US009678450B2

(12) United States Patent
Kumai et al.

(10) Patent No.: US 9,678,450 B2
(45) Date of Patent: Jun. 13, 2017

(54) TONER AND TWO-COMPONENT DEVELOPER

(71) Applicants: Mio Kumai, Shizuoka (JP); Hideki Sugiura, Shizuoka (JP); Yuka Mizoguchi, Shizuoka (JP)

(72) Inventors: Mio Kumai, Shizuoka (JP); Hideki Sugiura, Shizuoka (JP); Yuka Mizoguchi, Shizuoka (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 14/783,945

(22) PCT Filed: Apr. 25, 2014

(86) PCT No.: PCT/JP2014/062211

§ 371 (c)(1),
(2) Date: Oct. 12, 2015

(87) PCT Pub. No.: WO2014/175469

PCT Pub. Date: Oct. 30, 2014

(65) Prior Publication Data

US 2016/0070191 A1 Mar. 10, 2016

(30) Foreign Application Priority Data

Apr. 26, 2013 (JP) ..... 2013-094681
Feb. 26, 2014 (JP) ..... 2014-035388

(51) Int. Cl.
*G03G 9/087* (2006.01)
*G03G 9/093* (2006.01)
(Continued)

(52) U.S. Cl.
CPC ..... *G03G 9/093* (2013.01); *G03G 9/0821* (2013.01); *G03G 9/08755* (2013.01);
(Continued)

(58) Field of Classification Search
CPC ..... G03G 9/08755; G03G 9/0821; G03G 9/0819; G03G 9/093; G03G 9/08764
See application file for complete search history.

(56) References Cited

U.S. PATENT DOCUMENTS

2006/0105258 A1* 5/2006 Ishiyama ..... G03G 9/0821 430/110.2
2008/0102395 A1 5/2008 Ohmura et al.
(Continued)

FOREIGN PATENT DOCUMENTS

JP 2006-235585 9/2006
JP 2008-065006 3/2008
(Continued)

OTHER PUBLICATIONS

International Search Report Issued Jul. 8, 2014 in PCT/JP2014/062211 filed Apr. 25, 2014.
(Continued)

*Primary Examiner* — Christopher Rodee
(74) *Attorney, Agent, or Firm* — Oblon, McClelland, Maier & Neustadt, L.L.P.

(57) ABSTRACT

Provided is [i] a toner including at least a colorant, a resin, and a releasing agent, wherein a spin-spin relaxation time ($t_2$) of the toner at 90° C. obtained by Hahn Echo method of pulse NMR analysis is from 1.80 msec to 7.00 msec. Also provided is [ii] a toner according to [i], wherein the spin-spin relaxation time ($t_2$) of the toner at 90° C. obtained by Hahn Echo method of pulse NMR analysis is from 3.80 msec to 5.90 msec.

18 Claims, 1 Drawing Sheet

(51) Int. Cl.
*G03G 9/08* (2006.01)
*G03G 9/107* (2006.01)

(52) U.S. Cl.
CPC ..... *G03G 9/08764* (2013.01); *G03G 9/08795* (2013.01); *G03G 9/08797* (2013.01); *G03G 9/107* (2013.01)

(56) References Cited

U.S. PATENT DOCUMENTS

| | | | | |
|---|---|---|---|---|
| 2008/0171280 | A1 | 7/2008 | Ohmura et al. | |
| 2010/0216066 | A1* | 8/2010 | Kadokura | G03G 9/0819 430/108.1 |
| 2011/0300477 | A1* | 12/2011 | Yoshida | G03G 9/0821 430/105 |
| 2012/0064447 | A1 | 3/2012 | Hozumi et al. | |
| 2012/0295193 | A1 | 11/2012 | Hanatani et al. | |
| 2014/0080050 | A1* | 3/2014 | Asahina | G03G 9/08755 430/109.4 |
| 2015/0072287 | A1* | 3/2015 | Amemori | G03G 9/08755 430/109.4 |
| 2015/0132690 | A1* | 5/2015 | Asahina | G03G 9/08755 430/105 |
| 2015/0234302 | A1 | 8/2015 | Kumai et al. | |
| 2015/0268574 | A1* | 9/2015 | Miyaake | G03G 9/08733 430/109.4 |

FOREIGN PATENT DOCUMENTS

| | | |
|---|---|---|
| JP | 2012-063496 | 3/2012 |
| JP | 2012-108462 | 6/2012 |
| JP | 2013-057906 | 3/2013 |
| JP | 2013-057914 | 3/2013 |
| JP | 2014-048551 | 3/2014 |
| WO | WO 2014/034963 A1 | 3/2014 |

OTHER PUBLICATIONS

Extended European Search Report issued Mar. 15, 2016 in Patent Application No. 14788293.0.

* cited by examiner

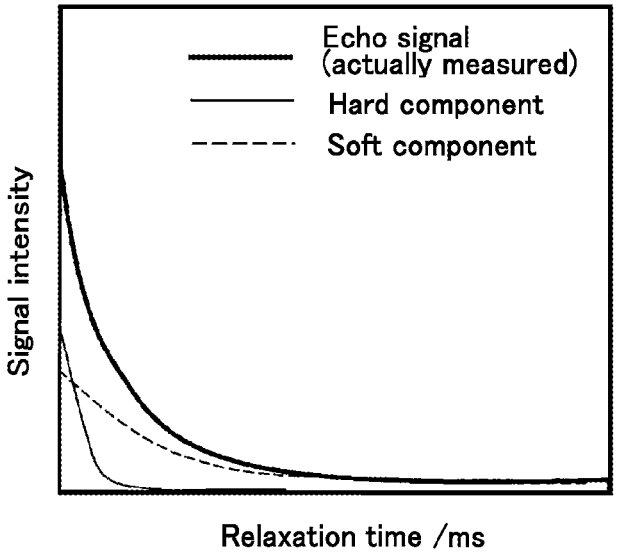
Echo signal
(actually measured)
Hard component
Soft component
Signal intensity
Relaxation time /ms

TONER AND TWO-COMPONENT DEVELOPER

TECHNICAL FIELD

The present invention relates to a toner and a two-component developer using the toner.

BACKGROUND ART

Image forming apparatuses such as electrophotography apparatuses and electrostatic recording apparatuses form an image by developing an electrostatic latent image formed on a photoconductor with a toner, transferring the formed toner image onto a recording medium such as a sheet, and after this, fixing the transferred image by heating. In the formation of a full-color image, four colors of toners of black, yellow, magenta, and cyan are used for development. After toner images of the respective colors are transferred onto a recording medium and overlaid together, the images are simultaneously fixed by heating.

In order to reduce environmental impacts to the earth, considerations are being given to reducing the fixing temperature of the toner. However, a toner having a low melting point has poor heat resistant storage stability. Therefore, it is requested to satisfy low temperature fixability and heat resistant storage stability simultaneously. For example, PTL 1 describes an attempt to simultaneously satisfy low temperature fixability and heat resistant storage stability by optimizing the amount of crystalline polyester to be incorporated into the toner according to the particle size distribution of the toner. PTL 2 describes an attempt to simultaneously satisfy low temperature fixability and heat resistant storage stability, and to secure a separating property, by realizing compatible state and incompatible state of crystalline polyester in the toner simultaneously.

CITATION LIST

Patent Literature

PTL 1 Japanese Patent Application Laid-Open (JP-A) No. 2012-063496

PTL 2 JP-A No. 2012-108462

SUMMARY OF INVENTION

Technical Problem

Examples of the means for simultaneously satisfying low temperature fixability and heat resistant storage stability include keeping the toner having hardness in the low temperature range. However, this tends to incur degradation of ductility and degradation of color reproducibility. For example, such a toner design is practiced, in which the toner has a core-shell structure, and includes a large amount of crystalline resin in the core, to thereby have improved low temperature fixability. However, because the shell layer is made of a resin having a high hardness in order to secure the heat resistant storage stability, degradation of ductility cannot be avoided, leaving the problem of color reproducibility degradation unsolved.

Hence, the present invention aims to provide a toner that can simultaneously satisfy excellent low temperature fixability and color reproducibility and also has excellent heat resistant storage stability.

Solution to Problem

As the result of earnest studies, the present inventors have found that the problems described above can be solved by the following invention 1).

1) A toner, including:

a colorant;

a resin; and a releasing agent, wherein a spin-spin relaxation time ($t_2$) of the toner at 90° C. obtained by Hahn Echo method of pulse NMR analysis is from 1.80 msec to 7.00 msec.

Advantageous Effects of Invention

The present invention can provide a toner that can simultaneously satisfy excellent low temperature fixability and color reproducibility and also has excellent heat resistant storage stability.

BRIEF DESCRIPTION OF DRAWINGS

FIG. 1 is a diagram showing an attenuation curve of spin-spin relaxation time.

DESCRIPTION OF EMBODIMENTS (Toner)

The toner of the invention 1) described above will be explained below in detail. The embodiments of the present invention also include the following 2) to 10), and they will also be explained below together.

A toner, a manufacturing method and materials of a developing agent, and a whole system involved in an electrophotography process may be any conventional ones, as long as they satisfy conditions.

2) The toner according to 1), wherein the spin-spin relaxation time ($t_2$) of the toner at 90° C. obtained by Hahn Echo method of pulse NMR analysis is from 3.80 msec to 5.90 msec.

3) The toner according to 1) or 2), wherein of a soft component and a hard component of the toner at 90° C. obtained by Hahn Echo method of pulse NMR analysis, the hard component has a spin-spin relaxation time ($t_H$) that satisfies the following relational expression <1> or <2> where is represents a spin-spin relaxation time attributed to the soft component:

$$\text{when } t_S \geq 25.00 \text{ msec}, t_H \leq 2.00 \text{ msec} \quad \langle 1 \rangle,$$

$$\text{when } t_S < 25.00 \text{ msec}, t_H \geq 1.10 \text{ msec} \quad \langle 2 \rangle.$$

4) The toner according to any one of 1) to 3), wherein in DSC of the toner in a range of from 0° C. to 100° C., a maximum endothermic peak temperature T1 of the toner at a first temperature raising and a maximum exothermic peak temperature T2 of the toner at a temperature lowering satisfy the following relational expression <3>, $$T1 - T2 \leq 30.0° \text{ C. and } T2 \geq 30.0° \text{ C.} \quad \langle 3 \rangle.$$

5) The toner according to any one of 1) to 4), wherein in the DSC of the toner in the range of from 0° C. to 100° C., a maximum endothermic peak temperature of the toner at a second temperature raising is in a range of from 50° C. to 70° C., and an amount of heat of melting of the toner at the second temperature raising is 30.0 J/g or greater.

6) The toner according to any one of 1) to 5), wherein when a tetrahydrofuran (THF) soluble content of the toner is measured with gel permeation chromatography (GPC), a ratio of a content of the THF soluble content that has a molecular weight of 100,000 or greater is 5% or greater, and a weight average molecular weight (Mw) of the THF soluble content is 20,000 or greater.

7) The toner according to any one of 1) to 6), wherein the toner has a core-shell structure, and a shell of the core-shell structure has a thickness of 40 nm or less.

8) The toner according to any one of 1) to 7), wherein the resin contains a crystalline polyester resin.

9) The toner according to 8), wherein the crystalline polyester resin contains at least a urethane bond, a urea bond, or both thereof.

10) A two-component developer, including the toner according to any one of 1) to 9); and a carrier having a magnetic property.

The spin-spin relaxation time ($t_2$) of the present invention is a characteristic value of the toner that takes thermal behavior of the toner into consideration. The value $t_2$ is a spin-spin relaxation time calculated from an attenuation curve obtained from measurement of the toner according to Hahn Echo method of pulse NMR analysis. The spin-spin relaxation time ($t_2$) indicates the mobility of the molecules constituting the toner. Therefore, based on the spin-spin relaxation time, it is possible to evaluate the hardness of the toner at a certain temperature. For example, when molecules constituting a toner having a low melting point are heated, the molecules are highly mobile while they melt, and hence exhibit a long spin-spin relaxation time ($t_2$). When discussing fixability and color reproducibility, what is the most important is the melting behaviors of the toner when it passes through the fixing device and gets heated. Therefore, in the present invention, a spin-spin relaxation time ($t_2$) at 90° C. is to be evaluated, on the assumption of an image forming apparatus that seeks low temperature fixability.

In the present invention, one example method for changing the spin-spin relaxation time ($t_2$) is to change the content of a sharp-melting crystalline resin. The greater the content of the sharp-melting crystalline resin, the lower the melting point of the toner on the whole, which results in a higher mobility of the molecules at a certain temperature, and hence a longer spin-spin relaxation time ($t_2$). Even when the content of the crystalline resin is small, it is possible to obtain a long spin-spin relaxation time ($t_2$) at 90° C., by generating a minutely dispersed state of the crystalline resin, such as by performing annealing under appropriate conditions. This is because minute dispersion increases the contact area between the crystalline resin and a non-crystalline resin, to thereby increase the melting performance of the toner on the whole.

Further, when the toner has a core-shell structure, another method is to change the thickness of the shell. Because a shell is typically composed of molecules having lower mobility than the molecules of the core, the thicker the shell having the lower mobility, the lower the molecular mobility of the toner on the whole, resulting in a shorter spin-spin relaxation time ($t_2$). Therefore, in order to control the spin-spin relaxation time ($t_2$) of the sample on the whole, it is important to take a balance of the content of the crystalline resin and the thickness of the shell.

The spin-spin relaxation time ($t_2$) of the present invention is from 1.80 msec to 7.00 msec. When the spin-spin relaxation time ($t_2$) is 1.80 msec or longer or preferably 3.80 msec or longer, the toner will melt well even at a low temperature and will hence have a good affinity with a fixing medium (e.g., a sheet) to be fixed well thereon. Moreover, because the toner is not to have too high a hardness, it has a good ductility and color reproducibility. On the other hand, when the spin-spin relaxation time ($t_2$) is 7.00 msec or shorter or more preferably 5.90 msec or shorter, the toner is not to have too low a hardness, and will hence have a good heat resistant storage stability.

The attenuation curve obtained according to the method described above can be divided into two curves attributed to a hard component and a soft component constituting the toner, respectively (see the FIGURE). A spin-spin relaxation time obtained from the curve attributed to the hard component is defined as $t_H$, and a spin-spin relaxation time obtained from the curve attributed to the soft component is defined as $t_S$. When the amount of a component having a low molecular mobility is increased such as by thickening the hard shell layer of the toner, the value of $t_H$ is reduced. On the other hand, when the amount of a component having a high molecular mobility is increased such as by increasing the amount of the crystalline resin, the value of $t_S$ is increased. When attempting to satisfy low temperature fixability, color reproducibility, and heat resistant storage stability simultaneously, it is very important to take a balance of the soft component and hard component of the toner. When the molecular mobility of the soft component is very high, and the mobility of the hard component is also high at the same time, the hardness of the toner on the whole is significantly low, resulting in degradation of the heat resistant storage stability, Conversely, when the molecular mobility of the soft component is very low and the mobility of the hard component is also low at the same time, the hardness of the toner on the whole is significantly high, resulting in degradation of the low temperature fixability and color reproducibility. When $t_S \geq 25.00$ msec and $t_H \leq 2.00$ msec at the same time (i.e., when the soft component has a very high mobility but the hard component has a low mobility), or when $t_S < 25.00$ msec and $t_H 1.10$ msec at the same time (i.e., when the soft component has a low mobility but the hard component has a high mobility), the toner has a balanced hardness on the whole, to thereby become able to satisfy low temperature fixability, color reproducibility, and heat resistant storage stability simultaneously.

When in DSC (Differential Scanning calorimetry) of the toner in the range of from 0° C. to 100° C., a maximum endothermic peak temperature T1 of the toner at a first temperature raising and a maximum exothermic peak temperature T2 of the toner at a temperature lowering satisfy the following relational expression <3>, more preferably the following relational expression <4>, or yet more preferably the following relational expression <5>, there occurs an effect of lowering the melting point of the toner to a further lower temperature, and of raising the freezing point of the toner to a further higher temperature, which is preferable because low temperature fixing becomes possible without generation of any mark of scuffing resistance during paper discharging.

$$T1-T2 \geq 30.0° \text{ C. and } T2 \geq 30.0° \text{ C.} \quad <3>$$

$$T1-T2 \leq 25.0° \text{ C. and } T2 \geq 38.0° \text{ C.} \quad <4>$$

$$T1-T2 \leq 25.0° \text{ C. and } T2 \geq 40.0° \text{ C.} \quad <5>$$

Further, it is preferable if a maximum endothermic peak temperature of the toner at a second temperature raising in the DSC of the toner in the range of from 0° C. to 100° C. is 50° C. or higher, because it becomes less likely for toner blocking to occur. Further, it is preferable if this maximum endothermic peak temperature is lower than 70° C., because low temperature fixing becomes possible. Yet further, it is preferable if the amount of heat of melting at the second temperature raising is 30.0 Jig or greater, and more preferably 45.0 J/g or greater, because this means that the toner contains crystalline portions in a large amount and hence has an improved sharp melting property, to thereby enable low temperature fixing.

When a tetrahydrofuran (THF) soluble content of the toner is measured with gel permeation chromatography (GPC), it is preferable if the ratio of a content of the THF soluble content that has a molecular weight of 100,000 or greater is 5% or higher and more preferably 7% or higher, and the weight average molecular weight (Wt) of the THF soluble content is 20,000 or greater, because it is possible to obtain a toner of which viscoelasticity after melted can be controlled favorably, and that can be fixed at temperature and speed that are constant regardless of the sheet types. This is also preferable because the amount of the low molecular weight component having a low melting point can be controlled favorably and degradation of the heat resistant storage stability is suppressed.

When the toner has a core-shell structure, it is preferable if the thickness of the shell is 40 nm or less, because the toner will have excellent ductility and good color reproducibility.

Further, it is more preferable if the resin constituting the toner contains a crystalline polyester resin, because this will increase the allowance of low temperature fixing designing.

Further, it is preferable if the crystalline polyester resin contains a urethane bond, a urea bond, or both thereof, because the crystalline polyester resin will exhibit a high hardness while keeping the crystallinity to qualify as a resin.

A two-component developer containing the toner of the present invention and a carrier having a magnetic property is preferable because it can ensure toner flowability appropriately, allows appropriate development and transfer, and is highly environmentally safe (reliable).

(Pulse NMR Analysis)

In the present invention, pulse NMR analysis of the toner is preferably performed in the following manner.

That is, with the use of pulse NMR; MINISPEC MQ SERIES manufactured by Bruker Japan Co., Ltd., a high frequency magnetic field is applied in the form of pulse to the toner loaded into a NMR tube, a magnetization vector is inclined, and the mobility of the molecules constituting the toner is evaluated based on the time taken for the x and y components of the magnetization vector to be extinct (=relaxation time).

(1) Sample

The toner is weighed to be loaded in an amount of 40 mg into a NMR tube having a diameter of 10 mm, warmed for 15 minutes with a preheater adjusted to 90° C., and used for measurement. A sample that has a temperature of 90° C., but has become this temperature of 90° C. after having been once heated to higher than 90° C. and then cooled has undergone a great crystalline state change and has got completely different properties. Therefore, it is necessary to start warming the sample after adjusting the preheater to 90° C.

(2) Measurement Conditions

Hahn echo method
First 90° Pulse Separation; 0.01 msec
Final Pulse Separation; 20 msec
Number of Data Point for Fitting; 40 points
Cumulated number; 32 times
Temperature; 90° C.

(3) Method for Calculating Spin-Spin Relaxation Time ($t_2$)

With the use of exponential approximation of ORIGIN 8.5 (manufactured by OriginLab Corporation), the spin-spin relaxation time ($t_2$) is calculated from an attenuation curve obtained according to the Hahn Echo method of pulse NMR measurement. Spin-spin relaxation time is known to be shorter as the molecular mobility is lower, and longer as the molecular mobility is higher.

(4) Method for Calculating Spin-Spin Relaxation Times ($t_H$, $t_S$)

An attenuation curve obtained according to the Hahn Echo method of pulse NMR measurement is a superposition of relaxation curves attributed to two components, namely a hard component having a low molecular mobility and a soft component having a high molecular mobility. With the use of Bi-exponential approximation of ORIGIN 8.5 (manufactured by OriginLab Corporation), it is possible to separate an obtained echo signal into two relaxation curves attributed to the two components, and calculate the spin-spin relaxation times ($t_H$, $t_S$) of the respective components.

The FIGURE shows three relaxation curves including an example attenuation curve, and a hard component and soft component obtained by decomposing the attenuation curve. The hard component having a low molecular mobility is generally a component attributed to a hard material, whereas the soft component having a high molecular mobility is attributed to a soft material. Spin-spin relaxation time is known to be shorter as the molecular mobility is lower, and longer as the molecular mobility is higher. Therefore, of the two relaxation curves resulting from the separation, the relaxation curve having the shorter spin-spin relaxation time is said to represent the hard component, and the relaxation curve having the longer spin-spin relaxation time is said to represent the soft component.

[DSC (Differential Scanning Calorimetry)]

In the present invention, it is possible to measure maximum endothermic peak, maximum exothermic peak, and amount of heat of melting of the toner with the use of a DSC system Q-200 (manufactured by TA Instruments LLC).

First, a resin (about 5.0 mg) is loaded into an aluminum-made sample vessel, and the sample vessel is mounted on a holder unit and set in an electric furnace. Next, under a nitrogen atmosphere, the temperature is raised from 0° C. to 100° C. at a rate of 10° C./min, then lowered from 100° C. to 0° C. at a rate of 10° C./min, after this, again raised from 0° C. to 100° C. at a rate of 10° C./min, endothermic and exothermic changes are measured. Then, with the use of an analyzing program of the DSC system Q-200 (manufactured by TA Instruments LLC), the DSC curve at the first temperature raising is selected in order to measure the maximum endothermic peak temperature T1 at the first temperature raising. Likewise, the maximum exothermic peak temperature T2 at the temperature lowering is measured. Furthermore, the DSC curve at the second temperature raising is selected in order to measure the maximum endothermic peak temperature at the second temperature raising. The endothermic amount of the endothermic peak having the maximum endothermic peak temperature at the second temperature raising is referenced as the amount of heat of melting at the second temperature raising.

[Molecular Weight Distribution and Weight Average Molecular Weight (Mw)]

In the present invention, molecular weight distribution and weight average molecular weight (Mw) can be measured with a gel permeation chromatography (GPC) measuring instrument (e.g., GPC-8220GPC (manufactured by Tosoh Corporation)). The column to be used is a 15 cm three-serial column TSKGEL SUPER HZM-H. The resin to be measured is prepared as a 0.15% by mass solution in tetrahydrofuran (THF) (containing a stabilizer, manufactured by Wako Pure Chemical Industries, Ltd.), and filtered through a 0.2 μm filter. The resulting filtrate is used as the sample. This THF sample solution (100 μL) is poured into the measuring instrument, and measured at 40° C. at a flow rate of 0.35 mL/minute. The molecular weight of the sample is calculated from a relationship between the logarithmic value of a calibration curve generated based on several kinds of monodisperse polystyrene standard samples and the counted value. The polystyrene standard samples to be used are SHOWDEX STANDARD Std. Nos. S-7300, S-210, S-390, S-875, S-1980, S-10.9, S-629, S-3.0, and S-0.580 manufactured by Showa Denko K.K., and toluene. The detector to be used is a RI (Refraction Index) detector.

(Crystalline Polyester Resin)

In the present invention, it is preferable to use the crystalline polyester resin described below. The melting point of the crystalline polyester resin is preferably in the range of from 50° C. to 100° C., more preferably in the range of from 55° C. to 90° C., and yet more preferably in the range of from 55° C. to 85° C. With a melting point of 50° C. or higher, the toner will not cause blocking during storage, and storage of the toner and storage of a fixed image after fixed will be favorable. With a melting point of 100° C. or lower, a sufficient low temperature stability is obtained. The melting point of the crystalline polyester resin can be obtained as the peak temperature of an endothermic peak obtained from the differential scanning calorimetry (DSC) described above.

The "crystalline polyester resin" in the present invention includes not only a polymer made of a polyester structure by 100%, but also a copolymer of a monomer constituting polyester and another monomer. However, the ratio of the another monomer in the copolymer needs to be 50% by mass or less.

The crystalline polyester resin used in the toner of the present invention is synthesized from, for example, a polyvalent carboxylic acid component and a polyhydric alcohol component. The crystalline polyester resin may be a commercially available product or may be a synthesized product.

Examples of the polyvalent carboxylic acid include: aliphatic dicarboxylic acids such as oxalic acid, succinic acid, glutaric acid, adipic acid, suberic acid, azelaic acid, sebacic acid, 1,9-nonanedicarboxylic acid, 1,10-decanedicarboxylic acid, 1,12-dodecanedicarboxylic acid, 1,14-tetradecanedicarboxylic acid, 1,18-octadecanedicarboxylic acid; and aromatic dicarboxylic acids such as diacids such as phthalic acid, isophthalic acid, terephthalic acid, naphthalene-2,6-dicarboxylic acid, malonic acid, and mesakonin acid. Examples thereof further include anhydride and lower alkyl ester of those listed above.

Examples of trivalent or higher carboxylic acids include: 1,2,4-benzenetricarboxylic acid, 1,2,5-benzenetricarboxylic acid, 1,2,4-naphthalenetricarboxylic acid; and anhydride and lower alkyl ester of those listed above.

One of these may be used alone or two or more of these may be used in combination.

The acid component may also contain dicarboxylic acid component having a sulfonic acid group, in addition to the carboxylic acid. The acid component may further contain a dicarboxylic acid component having a double bond.

The polyhydric alcohol component is preferably an aliphatic diol, and more preferably a straight-chain aliphatic diol having 7 to 20 carbon atoms in the main chain. When the polyhydric alcohol component is a branched aliphatic diol, the crystallinity of the polyester resin may be poor to thereby cause depression of the melting temperature. When the number of carbon atoms in the main chain is less than 7, a condensation polymerization product of the polyhydric alcohol component and an aromatic dicarboxylic acid will have a high melting temperature, to thereby make low temperature fixing harder. On the other hand, when the number of carbon atoms in the main chain is greater than 20, it may be difficult to procure material for practical use. The number of carbon atoms in the main chain is more preferably 14 or less.

An aliphatic diol accounts for preferably 80 mol % or greater, and more preferably 90 mol % or greater of the whole polyhydric alcohols. When the aliphatic diol accounts for less than 80 mol %, the crystallinity of the polyester resin may be poor to thereby cause depression of the melting temperature, which may result in degradation of toner blocking resistance, image storage stability, and low temperature fixability.

Examples of the aliphatic diol include ethylene glycol, 1,3-propanediol, 1,4-butanediol, 1,5-pentanediol, 1,6-hexanediol, 1,7-heptanediol, 1,8-octanediol, 1-9-nonanediol, 1,10-decanediol, 1,11-undecanediol, 1,12-dodecanediol, 1,13-tridecanediol, 1,14-tetradecanediol, 1,18-octadecanediol and 1,14-eicosanedecanediol. Among these, 1,8-octanediol, 1-9-nonanediol, and 1,10-decanediol are preferable in view of easy availability.

Examples of trihydric or higher alcohol include glycerin, trimethylolethane, trimethylolpropane, and pentaerythritol.

One of these may be used alone or two or more of these may be used in combination.

For optional purposes such as adjusting an acid value and a hydroxyl value, it is possible to add the polyvalent carboxylic acid and the polyhydric alcohol at the final stage of the synthesis.

Examples of the polyvalent carboxylic acid include: aromatic carboxylic acids such as terephthalic acid, isophthalic acid, phthalic anhydride, trimellitic anhydride, pyromellitic acid, and naphthalene dicarboxylic acid; aliphatic carboxylic acids such as maleic anhydride, fumaric acid, succinic acid, alkenyl succinic anhydride, and adipic acid; and alicyclic carboxylic acid such as cyclohexanedicarboxylic acid.

Examples of the polyhydric alcohol include: aliphatic diols such as ethylene glycol, diethylene glycol, triethylene glycol, propylene glycol, butanediol, hexanediol, neopenthyl glycol, and glycerin; alicyclic diols such as cyclohexanediol, cyclohexanedimethanol, and hydrogenated bisphenol A; and aromatic diols such as bisphenol A-ethylene oxide adduct and bisphenol A-propylene oxide adduct.

The crystalline polyester resin may be produced at a polymerization temperature of from 180° C. to 230° C. The reaction is promoted by reducing the pressure in the reaction system if necessary, and removing water and alcohol to be produced from the condensation.

When a monomer is insoluble or incompatible at the reaction temperature, it is possible to add a solvent having a high boiling point as a solubilizing agent in order to dissolve the monomer. The polycondensation reaction is promoted by distilling the solubilizing agent away. When any monomer to be copolymerized may be poorly compatible, it is possible to previously condense the poorly compatible monomer with the acid or alcohol with which the monomer is to be polycondensed, before polycondensing the monomer with the main components.

Examples of the catalyst that can be used for the production of the polyester resin include: alkali metal compounds such as sodium and lithium; alkaline-earth metal compounds such as magnesium and calcium; metal compounds such as zinc, manganese, antimony, titanium, tin, zirconium, and germanium; phosphite compounds; phosphate compounds; and amine compounds.

Specific examples of the catalyst include compounds such as sodium acetate, sodium carbonate, lithium acetate, lithium carbonate, calcium acetate, calcium stearate, magnesium acetate, zinc acetate, zinc stearate, zinc naphthenate, zinc chloride, manganese acetate, manganese naphthenate, titanium tetraethoxide, titanium tetrapropoxide, titanium tetraisopropoxide, titanium tetrabutoxide, antimony trioxide, triphenyl antimony, tributylantimony, tin formate, tin oxalate, tetraphenyltin, dibutyltindichloride, dibutyltinoxide, diphenyltinoxide, zirconium tetrabutoxide, zirconium naphthenate, zirconyl carbonate, zirconyl acetate, zirconyl stearate, zirconyl octylate, germanium oxide, triphenylphosphite, tris(2,4-di-t-butylphenyl)phosphite, ethyltriphenylphosphoniumbromide, triethylamine, and triphenylamine.

The acid value of the crystalline polyester resin (the quantity of KOH in the mg unit necessary for neutralizing 1 g of resin) is preferably in the range of from 3.0 mgKOH/g to 30.0 mgKOH/g, more preferably in the range of from 6.0 mgKOH/g to 25.0 mgKOH/g, and still more preferably in the range of from 8.0 mgKOH/g to 20.0 mgKOH/g.

When the acid value is less than 3.0 mgKOH/g, the resin becomes poorly dispersible in water, which may make it very difficult to manufacture the particles of the resin by wet process. Further, the particles would very poorly keep stabilized as a polymerized product when they are aggregated, which may make it difficult to realize efficient manufacture of a toner. On the other hand, when the acid value is greater than 30.0 mgKOH/g, the toner would have increased hygroscopicity and would be more susceptible to influences from the environment.

The weight average molecular weight (Mw) of the crystalline polyester resin is preferably from 6,000 to 35,000. When the weight average molecular weight (Mw) is 6,000 or greater, the toner would not sink into the surface of the recording medium such as paper when fixed thereon to be thereby prevented from being unevenly fixed, or would not weaken the strength of resistance of the fixed image to folding. When the weight average molecular weight (Mw) is 35,000 or less, the viscosity of the toner when melted would not be so high that the temperature at which the viscosity reaches the suitable level for fixing would be high, to thereby prevent the low temperature fixability from being degraded.

The main component (50% by mass or greater) of the crystalline resin containing the crystalline polyester resin described above is preferably a crystalline polyester resin synthesized by using an aliphatic monomer (hereinafter, may be referred to as "crystalline aliphatic polyester resin"). In this case, the composition ratio of an aliphatic monomer that constitutes the crystalline aliphatic polyester resin is preferably 60 mol % or higher, more preferably 90 mol % or higher. Preferable examples of the aliphatic monomer include the aliphatic diols and carboxylic acids listed above.

The content of the crystalline polyester resin in the toner is preferably in the range of from 10% by mass to 85% by mass. When the content of the crystalline polyester resin is less than 10% by mass, a sufficient low temperature fixability may not be obtained. When the content is greater than 85% by mass, a sufficient strength of the toner and of a fixed image may not be obtained, and chargeability may also be disadvantaged.

(Non-Crystalline Polyester Resin)

In the present invention, it is preferable to add a non-crystalline polyester resin described below as the binder resin of the toner. The non-crystalline polyester resin may be a modified polyester resin or an unmodified polyester resin, but more preferably may contain both.

(Modified Polyester Resin)

The modified polyester resin may be a modified polyester-based resin.

Examples thereof include a polyester prepolymer having an isocyanate group. Examples of the polyester prepolymer (A) having an isocyanate group include a product obtained by reacting such a polyester as is a polycondensation product of polyol (1) and polycarboxylic acid (2) and as has an active hydrogen group, further with polyisocyanate (3). Examples of the active hydrogen group of the polyester include hydroxyl groups (alcoholic hydroxyl groups and phenolic hydroxyl groups), amino groups, carboxyl groups, and mercapto groups. Of these, alcoholic hydroxyl groups are preferable.

Examples of the polyol (1) include diol (1-1) and trihydric or higher polyol (1-2), with diol (1-1) alone or a mixture of diol (1-1) and a small amount of trihydric or higher polyol (1-2) being preferred. Examples of the diol (1-1) include alkylene glycols (e.g., ethylene glycol, 1,2-propylene glycol, 1,3-propylene glycol, 1,4-butanediol, and 1,6-hexanediol); alkylene ether glycols (e.g., diethylene glycol, triethylene glycol, dipropylene glycol, polyethylene glycol, polypropylene glycol, and polytetramethylene ether glycol); alicyclic diols (e.g., 1,4-cyclohexanedimethanol and hydrogenated bisphenol A); bisphenols (e.g., bisphenol A, bisphenol F, and bisphenol S); alkylene oxide (e.g., ethylene oxide, propylene oxide, and butylene oxide) adducts of the above-listed alicyclic diols; and alkylene oxide (e.g., ethylene oxide, propylene oxide, and butylene oxide) adducts of the above-listed bisphenols. Of these, C2 to C12 alkylene glycols and alkylene oxide adducts of bisphenols are preferable. Alkylene oxide adducts of bisphenols, and combinations of alkylene oxide adducts of bisphenols with C2 to C12 alkylene glycols are particularly preferable.

Examples of the trihydric or higher polyol (1-2) include trihydric to octahydric or higher aliphatic polyalcohols (e.g., glycerin, trimethylolethane, trimethylolpropane, pentaerythritol, and sorbitol); trihydric or higher phenols (e.g., trisphenol PA, phenol novolac, and cresol novolac); and alkylene oxide adducts of the above trihydric or higher polyphenols.

Examples of the polycarboxylic acid (2) include dicarboxylic acid (2-1) and trivalent or higher polycarboxylic acid (2-2), with the dicarboxylic acid (2-1) alone or a mixture of the dicarboxylic acid (2-1) and a small amount of trivalent or higher polycarboxylic acid (2-2) being preferred.

Examples of the dicarboxylic acid (2-1) include alkylene dicarboxylic acids (e.g., succinic acid, adipic acid, and sebacic acid); alkenylene dicarboxylic acids (e.g., maleic acid and fumaric acid); aromatic dicarboxylic acids (e.g., phthalic acid, isophthalic acid, terephthalic acid, and naphthalene dicarboxylic acid). Of these, C4 to C20 alkenylenedicarboxylic acids and C8 to C20 aromatic dicarboxylic acids are preferable.

Examples of the trivalent or higher polycarboxylic acid (2-2) include C9 to C20 aromatic polycarboxylic acids (e.g., trimellitic acid and pyromellitic acid). Notably, the polycarboxylic acid (2) may be acid anhydrides or lower alkyl esters (e.g., methyl ester, ethyl ester, and isopropyl ester) of the above carboxylic acids.

The ratio between the polyol (1) and the polycarboxylic acid (2) is typically from 2/1 to 1/1, preferably from 1.5/1 to 1/1, more preferably from 1.3/1 to 1.02/1, in terms of the equivalent ratio [OH]/[COOH] of the hydroxyl group [OH] to the carboxyl group [COOH].

Examples of the polyisocyanate (3) include aliphatic polyisocyanates (e.g., tetramethylene diisocyanate, hexamethylene diisocyanate, and 2,6-diisocyanate methylcaproate); alicyclic polyisocyanates (e.g., isophorone diisocyanate and cyclohexylmethane diisocyanate); aromatic diisocyanates (e.g., tolylene diisocyanate and diphenylmethane diisocyanate); aromatic aliphatic diisocyanates (e.g., α,α,α',α'-tetramethyl xylylene diisocyanate); isocyanurates; polyisocyanates blocked with phenol derivative, oxime, caprolactam or the like; and combinations of two or more of these.

The ratio of the polyisocyanate (3), as the equivalent ratio [NCO]/[OH] of isocyanate group [NCO] to hydroxyl group [OH] of the polyester having the hydroxyl group, is typically from 5/1 to 1/1, preferably from 4/1 to 1.2/1, more preferably from 2.5/1 to 1.5/1.

When the equivalent ratio [NCO]/[OH] is greater than 5, the low temperature fixability may be poor. When the equivalent ratio [NCO]/[OH] is less than 1, the content of urea in the modified polyester is so low that hot offset resistance may be poor. The content of the constituent components of the polyisocyanate (3) in the prepolymer (A) having an isocyanate group at a terminal is typically from 0.5% by mass to 40% by mass, preferably from 1% by mass to 30% by mass, and more preferably from 2% by mass to 20% by mass. When the content is less than 0.5% by mass, hot offset resistance may be poor, and it may be disadvantageous for simultaneous satisfaction of heat resistant storage stability and low temperature fixability. When the content is greater than 40% by mass, low temperature fixability may be poor.

The number of isocyanate groups contained per molecule of the prepolymer (A) having an isocyanate group is typically from 1 or more, preferably from 1.5 to 3 on average, and more preferably from 1.8 to 2.5 on average. When the number is less than 1 per molecule, the molecular weight of the modified polyester will be low after cross-linking, elongation, or both thereof, which may degrade hot offset resistance.

(Unmodified Polyester)

In the present invention, instead of adding only the modified polyester (A), it is preferable to also add an unmodified polyester (C) as a toner binder component together with (A). Use of the unmodified polyester (C) in combination improves low temperature fixability, and also glossiness and uniformity of glossiness when the toner is used for a full-color apparatus. Examples of (C) include a polycondensation product of the same polyol (1) and polycarboxylic acid (2) as the polyester components of (A) listed above. Preferable examples of the polyol and polycarboxylic acid also include the same as those listed for (A). (C) may be not only a non-modified polyester, but also be one that is modified with a chemical bond other than a urea bond. For example, (C) may be one modified with a urethane bond. It is preferable if (A) and (C) have become compatible at least partially in the toner, in terms of low temperature fixability and hot offset resistance. Therefore, it is preferable if (A) and (C) have similar compositions. When adding (A), the mass ratio [(C)/(A)] between (A) and (C) is typically from 5/95 to 75/25, preferably from 10/90 to 25/75, yet more preferably from 12/88 to 25/75, and particularly preferably from 12/88 to 22/78. When the mass ratio of (A) is less than 5% by mass, the hot offset resistance may be poor, and it is also disadvantageous for simultaneous satisfaction of heat resistant storage stability and low temperature fixability.

The peak molecular weight of (C) is typically from 1,000 to 30,000, preferably from 1,500 to 10,000, and yet more preferably from 2,000 to 8,000. When the peak molecular weight is 1,000 or greater, heat resistant storage stability will not be poor. When it is 10,000 or less, low temperature fixability will not be poor.

The hydroxyl value of (C) is preferably 5 mgKOH/g or greater, more preferably from 10 mgKOH/g to 120 mgKOH/g, and particularly preferably from 20 mgKOH/g to 80 mgKOH/g. When the hydroxyl value is 5 mgKOH/g or greater, it is advantageous for simultaneous satisfaction of heat resistant storage stability and low temperature fixability.

The acid value of (C) is typically from 0.5 mgKOH/g to 40 mgKOH/g, and preferably from 5 mgKOH/g to 35 mgKOH/g. With an acid value, the toner will be less likely to be charged negatively.

When the acid value and the hydroxyl value are in the ranges described above respectively, the toner will be less susceptible to the influences from the environment under high-temperature, high-humidity conditions and low-temperature, low-humidity conditions, and will not produce a poor quality image.

The glass transition point (Tg) of the toner of the present invention is typically from 40° C. to 70° C., and preferably from 45° C. to 55° C. When Tg is 40° C. or higher, heat resistant storage stability of the toner will be good. When Tg is 70° C. or lower, low temperature fixability will be sufficient. With the coexistence of the polyester resin resulting from cross-linking, elongation, or both thereof, the toner of the present invention will exhibit better storage property than publicly-known polyester-based toners, in spite of the low glass transition point thereof.

The toner of the present invention has a storage elastic modulus of 10,000 dyne/cm$^2$ at a temperature (TG') of typically 100° C. or higher, and preferably from 110° C. to 200° C., when measured at a frequency of 20 Hz. When the temperature at which the above storage elastic modulus is obtained is lower than 100° C., hot offset resistance may be poor.

The toner of the present invention has a viscosity of 1,000 poise at a temperature (Tη) of typically 180° C. or lower, and preferably from 90° C. to 160° C., when measured at a frequency of 20 Hz. When the temperature (Tη) is higher than 180° C., low temperature fixability may be poor. That is, in terms of simultaneously satisfying low temperature fixability and hot offset resistance, it is preferable if TG' is higher than Tη. In other words, it is preferable if the difference between TG' and Tη (TG'−Tη) is 0° C. or more. A difference of 10° C. or more is more preferable, and a difference of 20° C. or more is particularly preferable. The upper limit of the difference is not particularly limited. Further, in terms of simultaneously satisfying heat resistant storage stability and low temperature fixability, the difference between Tη and Tg is preferably from 0° C. to 100° C., more preferably from 10° C. to 90° C., and particularly preferably from 20° C. to 80° C.

(Cross-Linking Agent and Elongating Agent)

In the present invention, it is possible to use amines as a crosslinking agent, an elongating agent, or both thereof.

Examples of the amines (B) include diamine (B1), trivalent or higher polyamine (B2), amino alcohol (B3), amino mercaptan (B4), amino acid (B5), and a product (B6) obtained by blocking an amino group of any of B1 to B5. Examples of the diamine (B1) include: aromatic diamine (e.g., phenylene diamine, diethyltoluene diamine, and 4,4'-diaminodiphenyl methane), alicyclic diamine (4,4'-diamino-3,3'-dimethyldicyclohexyl methane, diamine cyclohexane, and isophorone diamine), and aliphatic diamine (e.g., ethylene diamine, tetramethylene diamine, and hexamethylene diamine). Examples of the trivalent or higher polyamine (B2) include diethylene triamine, and triethylene tetramine. Examples of the amino alcohol (B3) include ethanol amine, and hydroxyethyl aniline Examples of the amino mercaptan (B4) include aminoethylmercaptan, and aminopropylmercaptan. Examples of the amino acid (B5) include amino propionic acid, and amino caproic acid. Examples of the product (B6) obtained by blocking an amino group of any of B1 to B5 include a ketimine compound and oxazoline compound obtained from any of the amines B1 to B5 and ketones (e.g., acetone, methyl ethyl ketone, and methyl isobutyl ketone). Among these amines (B), B1 and a mixture of B1 and a small amount of B2 are preferable.

In the crosslink, elongation, or both thereof, if necessary, it is possible to use a terminating agent to thereby adjust the molecular weight of the modified polyester to result from the reaction. Examples of the terminating agent include monoamines (e.g., diethylamine, dibutylamine, butylamine, and laurylamine), and a product obtained by blocking any of the monoamines (e.g., a ketimine compound).

The ratio of the amines (B), as the equivalent ratio [NCO]/[NHx] of isocyanate group [NCO] in the polyester prepolymer (A) having an isocyanate group to amino group [NHx] in the amines (B), is typically from 1/2 to 2/1, preferably from 1.5/1 to 1/1.5, and more preferably from 1.2/1 to 1/1.2. When [NCO]/[NHx] is greater than 2/1 or less than 1/2, the molecular weight of urea-modified polyester (i) will be low, and hot offset resistance will be poor.

(Colorant)

The colorant is not particularly limited and may be a publicly-known dye or pigment.

Examples of the colorant include carbon black, a nigrosin dye, iron black, naphthol yellow S, Hansa yellow (10G, 5G and G), cadmium yellow, yellow iron oxide, yellow ocher, yellow lead, titanium yellow, polyazo yellow, oil yellow, Hansa yellow (GR, A, RN and R), pigment yellow L, benzidine yellow (G and GR), permanent yellow (NCG), vulcan fast yellow (5G and R), tartrazinelake, quinoline yellow lake, anthrasan yellow BGL, isoindolinon yellow, colcothar, red lead, lead vermilion, is cadmium red, cadmium mercury red, antimony vermilion, permanent red 4R, parared, fiser red, parachloroorthonitro anilin red, lithol fast scarlet G, brilliant fast scarlet, brilliant carmine BS, permanent red (F2R, F4R, FRL, FRLL and F4RH), fast scarlet VD, vulcan fast rubin B, brilliant scarlet G, lithol rubin GX, permanent red F5R, brilliant carmine 6B, pigment scarlet 3B, Bordeaux 5B, toluidine Maroon, permanent Bordeaux F2K, Helio Bordeaux BL, Bordeaux 10B, BON maroon light, BON maroon medium, eosin lake, rhodamine lake B, rhodamine lake Y, alizarin lake, thioindigo red B, thioindigo maroon, oil red, quinacridone red, pyrazolone red, polyazo red, chrome vermilion, benzidine orange, perinone orange, oil orange, cobalt blue, cerulean blue, alkali blue lake, peacock blue lake, Victoria blue lake, metal-free phthalocyanine blue, phthalocyanine blue, fast sky blue, indanthrene blue (RS and BC), indigo, ultramarine, iron blue, anthraquinone blue, fast violet B, methyl violet lake, cobalt purple, manganese violet, dioxane violet, anthraquinone violet, chrome green, zinc green, chromium oxide, viridian, emerald green, pigment green B, naphthol green B, green gold, acid green lake, malachite green lake, phthalocyanine green, anthraquinone green, titanium oxide, zinc flower, lithopone, and a mixture of these.

The content of the colorant in the toner is typically from 1% by mass to 15% by mass, and preferably from 3% by mass to 10% by mass.

The colorant may be used in the form of a master batch in which it is combined with a resin.

Examples of the binder resin kneaded in the production of, or together with the master batch include, in addition to the aforementioned modified and unmodified polyester resins, styrene polymers or substituted products thereof (e.g., polystyrene, poly-p-chlorostyrene, and polyvinyl toluene); styrene-based copolymer (e.g., styrene-p-chlorostyrene copolymer, styrene-propylene copolymer, styrene-vinyl toluene copolymer, styrene-vinyl naphthalene copolymer, styrene-methyl acrylate copolymer, styrene-ethyl acrylate copolymer, styrene-butyl acrylate copolymer, styrene-octyl acrylate copolymer, styrene-methyl methacrylate copolymer, styrene-ethyl methacrylate copolymer, styrene-butyl methacrylate copolymer, styrene-methyl α-chloromethacrylate copolymer, styrene-acrylonitrile copolymer, styrene-vinyl methyl ketone copolymer, styrene-butadiene copolymer, styrene-isoprene copolymer, styrene-acrylonitrile-indene copolymer, styrene-maleic acid copolymer, and styrene-maleic acid ester copolymer); and others such as polymethyl methacrylate, polybutyl methacrylate, polyvinyl chloride, polyvinyl acetate, polyethylene, polypropylene, polyester, epoxy resin, epoxy polyol resin, polyurethane, polyamide, polyvinyl butyral, polyacrylic acid resin, rosin, modified rosin, terpene resin, aliphatic or alicyclic hydrocarbon resin, aromatic petroleum resin, chlorinated paraffin, and paraffin wax. These may be used alone or two or more of these may be used in combination.

It is possible to obtain the master batch by mixing and kneading the colorant with the resin for the master batch under a high shearing force. In the mixing and kneading, an organic solvent may be used for improving the interactions between the colorant and the resin. Moreover, a flashing method of mixing and kneading an aqueous paste of the colorant containing water with the resin and an organic solvent, transferring the colorant to the resin, and removing the water and the organic solvent is preferably used, because it is possible to use the resulting wet cake of the colorant as it is, without drying it. In the mixing and kneading, a high-shearing disperser such as a three-roll mill is preferably used.

(Releasing Agent)

The releasing agent may be a common wax.

The wax may be any conventional wax, and examples thereof include polyolefin wax (e.g., polyethylene wax and polypropylene wax); long-chain hydrocarbon (e.g., paraffin wax and SASOL wax); and carbonyl group-containing wax. Of these, carbonyl group-containing wax is preferable.

Examples of the carbonyl group-containing wax include polyalkanoic acid ester (e.g., carnauba wax, montan wax, trimethylolpropane tribehenate, pentaerythritol tetrabehenate, pentaerythritol diacetate dibehenate, glycerin tribehenate and 1,18-octadecanediol distearate); polyalkanol ester (e.g., tristearyl trimellitate and distearyl maleate); polyalkanoic acid amide (e.g., ethylenediamine dibehenylamide); polyalkylamide (e.g., trimellitic acid tristearylamide); and dialkyl ketone (e.g., distearyl ketone). Of these, polyalkanoic acid ester is preferred.

The melting point of the wax is typically from 40° C. to 160° C., preferably from 50° C. to 120° C., and more preferably from 60° C. to 90° C. When the melting point thereof is lower than 40° C., the wax may adversely affect the heat resistant storage stability. When the melting point of the wax is higher than 160° C., it is likely for cold offset to occur upon fixing at low temperatures.

The melt viscosity of the wax is preferably from 5 cps to 1,000 cps, and more preferably from 10 cps to 100 cps, when measured at a temperature higher by 20° C. than the melting point. When the melt viscosity of the wax is higher than 1,000 cps, the wax would exhibit poor effect in improving hot offset resistance and low temperature fixability.

The content of the wax in the toner is typically from 0% by mass to 40% by mass, and preferably from 3% by mass to 30% by mass.

(Charge Controlling Agent)

The toner of the present invention may contain a charge controlling agent according to necessity.

The charge controlling agent may be a publicly-known charge controlling agent, and examples thereof include nigrosine dyes, triphenylmethane dyes, chrome-containing metal complex dyes, molybdic acid chelate pigments, rhodamine dyes, alkoxy amines, quaternary ammonium salts (including fluorine-modified quaternary ammonium salts), alkylamides, phosphorus, phosphorus compounds, tungsten, tungsten compounds, fluorine active agents, metal salts of salicylic acid, and metal salts of salicylic acid derivatives.

Specific examples of the charge controlling agent include nigrosine dye BONTRON 03, quaternary ammonium salt BONTRON P-51, metal-containing azo dye BONTRON S-34, oxynaphthoic acid-based metal complex E-82, salicylic acid-based metal complex E-84 and phenol condensate E-89 (all manufactured by Orient Chemical Industries Co., Ltd.); quaternary ammonium salt molybdenum complex TP-302 and TP-415 (all manufactured by Hodogaya Chemical Co., Ltd.); quaternary ammonium salt COPY CHARGE PSY VP2038, triphenylmethane derivative COPY BLUE PR, quaternary ammonium salt COPY CHARGE NEG VP2036, and COPY CHARGE NX VP434 (all manufactured by Hoechst GmbH); LRA-901, and boron complex LR-147 (manufactured by Japan Carlit Co., Ltd.); copper phthalocyanine; perylene; quinacridone; azo pigments; and polymeric compounds having, as a functional group, a sulfonic acid group, carboxyl group, quaternary ammonium salt, etc.

The content of the charge controlling agent is not determined flatly, because it is determined depending on the type of the binder resin, on an optionally used additive, and on the toner producing method (including the dispersion method). However, the content of the charge controlling agent is preferably from 0.1 parts by mass to 10 parts by mass, and more preferably from 0.2 parts by mass to 5 parts by mass, relative to 100 parts by mass of the binder resin. When the content is greater than 10 parts by mass, the toner becomes excessively chargeable, to thereby reduce the effect of a main charge controlling agent and have a greater electrostatic force of attracting a developing roller, leading to degradation of flowability of the developer, or degradation of the image density. These charge controlling agents may be dissolved and dispersed after being melted and kneaded together with the master batch, and resin. The charge controlling agents may be, of course, directly added to an organic solvent when dissolution and dispersion is performed. Alternatively, the charge controlling agents may be fixed on surfaces of toner particles after the production of the toner particles.

(External Additives)

As an additive for assisting flowability, developability, and chargeability of colored particles, oxide particles are preferable. However, in combination thereof, fine inorganic particles and hydrophobized fine inorganic particles may be used.

It is more preferable to add at least one kind of fine inorganic particles of which hydrophobized primary particles have an average particle diameter of from 1 nm to 100 nm, and more preferably 5 nm to 70 nm. It is further preferable to add at least one kind of fine inorganic particles of which hydrophobized primary particles have an average particle diameter of 20 nm or less, and to add at least one kind of fine inorganic particles of which hydrophobized primary particles have an average particle diameter of 30 nm or greater. It is also preferable that the specific surface of these particles measured by BET method be from 20 $m^2/g$ to 500 $m^2/g$.

Examples of fine inorganic particles such as oxide fine particles include silica, alumina, titanium oxide, barium titanate, magnesium titanate, calcium titanate, strontium titanate, iron oxide, copper oxide, zinc oxide, tin oxide, silica sand, clay, mica, wollastonite, diatomaceous earth, chromium oxide, cerium oxide, colcothar, antimony trioxide, magnesium oxide, zirconium oxide, barium sulfate, barium carbonate, calcium carbonate, silicon carbide, and silicon nitride. Among these, silica and titanium dioxide are particularly preferable.

In addition to those above, it is also possible to use metal salt of fatty acid (e.g., zinc stearate and aluminum stearate), fluoropolymer, and fine polymeric particles, i.e., particles of thermosetting resin polycondensate polymer, such as polystyrene, methacrylic acid ester, acrylic acid ester copolymer, silicone, benzoguanamine, and nylon obtained by, for example, soap-free emulsion polymerization, suspension polymerization, and dispersion polymerization.

Particularly preferable examples of the additive include hydrophobized silica, titania, titanium oxide, and alumina fine particles. Examples of silica fine particles include HDK H 2000, HDK H 2000/4, HDK H 2050EP, HVK21, and HDK H 1303 (manufactured by Hoechst GmbH), and R972, R974, RX200, RY200, R202, R805, and R812 (manufactured by Nippon Aerosil Co., Ltd.). Examples of titania fine particles include P-25 (manufactured by Nippon Aerosil Co., Ltd.), STT-30 and STT-65C-S (manufactured by Titan Kogyo Ltd.), TAF-140 (manufactured by Fuji Titanium Industry, Co., Ltd.), and MT-150W, MT-500B, MT-600B, and MT-150A (manufactured by Tayca Corp.). Particular examples of hydrophobized titanium oxide fine particles include T-805 (manufactured by Nippon Aerosil Co., Ltd.), STT-30A and STT-65S-S (manufactured by Titan Kogyo, Ltd.), TAF-500T and TAF-1500T (manufactured by Fuji Titanium Industry Co., Ltd.), MT-100S and MT-100T (manufactured by Tayca Corp.), and IT-S (manufactured by Ishihara Sangyo Kaisha Ltd.).

Hydrophobized oxide fine particles, silica fine particles, titania fine particles, and alumina fine particles can be obtained by treating hydrophilic fine particles with a silane coupling agent such as methyltrimethoxysilane, methyltriethoxysilane, and octyltrimethoxysilane. Silicone-oil treated oxide fine particle, which are obtained by treating oxide fine particles with a silicone oil while applying heat if necessary, are also preferable.

Examples of the silicone oil include dimethylsilicone oil, methylphenylsilicone oil, chlorophenylsilicone oil, methylhydrogensilicone oil, alkyl-modified silicone oil, fluorine-modified silicone oil, polyether-modified silicone oil, alcohol-modified silicone oil, amino-modified silicone oil, epoxy-modified silicone oil, epoxy/polyether-modified silicone oil, phenol-modified silicone oil, carboxyl-modified silicone oil, mercapto-modified silicone oil, acrylic, methacrylic-modified silicone oil, and α-methylstyrene-modified silicone oil.

Examples of the fine inorganic particles include silica, alumina, titanium oxide, barium titanate, magnesium titanate, calcium titanate, strontium titanate, iron oxide, copper oxide, zinc oxide, tin oxide, silica sand, clay, mica, wollastonite, diatomaceous earth, chromium oxide, cerium oxide, colcothar, antimony trioxide, magnesium oxide, zirconium oxide, barium sulfate, barium carbonate, calcium carbonate, silicon carbide, and silicon nitride. Among these, silica and titanium dioxide are particularly preferable. The additive amount thereof is from 0.1% by mass to 5% by mass, and preferably from 0.3% by mass to 3% by mass.

Other examples include fine polymeric particles, i.e., particles of thermosetting resin polycondensate polymer, such as polystyrene, methacrylic acid ester, acrylic acid ester copolymer, silicone, benzoguanamine, and nylon obtained by, for example, soap-free emulsion polymerization, suspension polymerization, and dispersion polymerization.

By surface-treating such a fluidizer to thereby improve hydrophobicity, it is possible to prevent degradation of fluidizing property and charging ability even under high-humidity conditions. Examples of preferable surface treating agents include a silane coupling agent, a silylation agent, a silane coupling agent having an alkyl fluoride group, an organic titanate coupling agent, an aluminum coupling agent, silicone oil, and modified silicone oil.

Examples of cleanability improving agents for removing the developer remained on the photoconductors and a first transfer medium after transfer include: fatty acid metal salts such as zinc stearate, calcium stearate, and stearic acid; and fine polymer particles produced by soap-free emulsion polymerization, such as polymethyl methacrylate fine particles, and polystyrene fine particles. Fine polymer particles having a relatively narrow particle size distribution and a volume average particle diameter of from 0.01 μm to 1 μm are preferable.

(Fine Resin Particles)

In the present invention, it is also possible to add fine resin particles, if necessary. The fine resin particles to be used preferably have a glass transition point (Tg) of from 40° C. to 100° C., and a weight average molecular weight (Mw) of from 3,000 to 300,000. When the glass transition point (Tg) is lower than 40° C., when the weight average molecular weight (Mw) is less than 3,000, or under both of these conditions, the storage property of the toner may be poor, and the toner may cause blocking when stored or in a developing device. When the glass transition point (Tg) is higher than 100° C., when the weight average molecular weight (Mw) is greater than 300,000, or under both of these conditions, the fine resin particles will inhibit adhesiveness with the fixing paper and will raise the minimum fixing temperature.

The residual ratio of the fine resin particles in the toner particles is preferably from 0.5% by mass to 5.0% by mass. When the residual ratio is less than 0.5% by mass, the storage property of the toner may be poor, and the toner may cause blocking when stored or in a developing device. When the residual ratio is greater than 5.0% by mass, the fine resin particles may inhibit exuding of the wax, resulting in an offset because the wax cannot exert its releasing effect.

In the measurement of the residual ratio of the fine resin particles, a pyrolysis gas chromatograph mass spectrometer may be used to analyze a substance attributable not to the toner particles but to the fine resin particles, and the ratio can be calculated from the detected peak area. The detector is preferably a mass spectrometer, but is not particularly limited.

The resin of the fine resin particles is not particularly limited as long as it can form an aqueous dispersion, and may be a thermoplastic resin or a thermosetting resin. Examples of the resin include vinyl resins, polylactic acid resins, polyurethane resins, epoxy resins, polyester resins, polyamide resins, polyimide resins, silicon resins, phenol resins, melamine resins, urea resins, aniline resins, ionomer resins, and polycarbonate resins. Two or more of these resins may be used in combination for the fine resin particles. Of the above resins, vinyl resins, polyurethane resins, epoxy resins, polyester resins, and their combinations are preferable, because an aqueous dispersion of fine spherical resin particles can be easily obtained from them.

Examples of vinyl resins include styrene-(meth)acrylate resins, styrene-butadiene copolymers, (meth)acrylic acid-acrylate polymers, styrene-acrylonitrile copolymers, styrene-maleic anhydride copolymers and styrene-(meth) acrylic acid copolymers.

(Manufacturing Method)

The binder resin of the toner can be manufactured according to the following method, for example.

The polyol (1) and the polycarboxylic acid (2) are heated to from 150° C. to 280° C. in the presence of a publicly-known esterification catalyst such as tetrabutoxy titanate and dibutyltin oxide under reduced pressure if necessary, while distilling away water to be produced, to thereby obtain polyester having a hydroxyl group. Next, the polyisocyanate (3) is reacted with the obtained polyester at from 40° C. to 140° C., to thereby obtain a prepolymer (A) having an isocyanate group.

A dry toner of the present invention can be manufactured according to the following method. However, the manufacturing method is not limited to the following.

(Method for Manufacturing Toner in Aqueous Medium)

It is preferable to previously add the fine resin particles in an aqueous medium. The fine resin particles will function as a particle diameter controlling agent, and will be deposited around the toner to eventually cover the surface of the toner and function as a shell layer. The function as the shell layer is affected by the particle diameter and composition of the fine resin particles, dispersant (surfactant) in the aqueous phase, solvent, etc. Therefore, these conditions must be controlled minutely.

The aqueous phase may be water alone, but may be combination of water and a solvent miscible with water. Examples of the miscible solvent include alcohol (methanol, isopropanol, and ethylene glycol), dimethylformamide, tetrahydrofuran, cellosolves (e.g., methyl cellosolve), and lower ketones (e.g., acetone and methyl ethyl ketone).

Toner particles can be formed by reacting in the aqueous phase, a dispersion obtained by dissolving or dispersing the polyester prepolymer (A) having an isocyanate group in an organic solvent, with the amines (B). Examples of the method for stably forming the dispersion of the polyester prepolymer (A) in the aqueous phase include a method of adding a toner material composition composed of the polyester prepolymer (A) dissolved or dispersed in the organic solvent to the aqueous phase and dispersing the toner material composition under a shearing force. It is possible to mix the polyester prepolymer (A) dissolved or dispersed in the organic solvent, with the other toner materials such as the colorant, a colorant master batch, the releasing agent, the charge controlling agent, and the unmodified polyester resin, when forming the dispersion in the aqueous phase. However, it is more preferable to mix the toner materials in advance, and then add the resulting mixture to the aqueous phase and disperse the mixture therein.

In the present invention, it is not indispensable to have had the other toner materials such as the colorant, the releasing agent, and the charge controlling agent mixed with the aqueous phase when forming the particles therein, and it is possible to add them after the particles are formed. For example, it is possible to form particles free from the colorant, and after this, add the colorant according to a publicly-known dyeing method.

The dispersing method is not particularly limited, and publicly-known equipment such as a low speed shearing system, a high speed shearing system, a friction system, a high-pressure jetting system, and an ultrasonic wave system can be used. A high speed shearing system is preferable in order to obtain a dispersion having a particle diameter of from 2 μm to 20 μm. When using a high speed shearing disperser, the rotation speed thereof is not particularly limited, but is typically from 1,000 rpm to 30,000 rpm, and preferably from 5,000 rpm to 20,000 rpm. The dispersion time is not particularly limited, but is typically from 0.1 minutes to 5 minutes, when the dispersing is performed batch-wise. The temperature during the dispersing is typically from 0° C. to 150° C. (under pressure), and preferably from 40° C. to 98° C. A higher temperature is preferable because the dispersion composed of the polyester prepolymer (A) will not grow in viscosity, and will be easily dispersed.

The amount of the aqueous phase to be used relative to 100 parts by mass of the toner composition containing the polyester prepolymer (A) is typically from 50 parts by mass to 2,000 parts by mass, and preferably from 100 parts by mass to 1,000 parts by mass. When the amount of use thereof is less than 50 parts by mass, the toner composition may not be dispersed well, and toner particles having a predetermined particle diameter may not be obtained. When the amount of use thereof is greater than 2,000 parts by mass, it is not economical. It is also possible to use a dispersant, according to necessity. Use of a dispersant is more preferable, because a sharp particle size distribution will be obtained, and the dispersing will be stable.

Examples of the dispersant for emulsifying or dispersing in the aqueous phase an oil phase in which the toner composition is dispersed include: anionic surfactants such as alkyl benzene sulfonic acid salts, α-olefin sulfonic acid salts and phosphoric acid esters; amine salts such as alkyl amine salts, amino alcohol fatty acid derivatives, polyamine fatty acid derivatives and imidazoline; quaternary ammonium salt cationic surfactants such as alkyltrimethylammonium salts, dialkyldimethylammonium salts, alkyl dimethyl benzyl ammonium salts, pyridinium salts, alkyl isoquinolinium salts and benzethonium chloride; nonionic surfactants such as fatty acid amide derivatives and polyhydric alcohol derivatives; and amphoteric surfactants such as alanine, dodecyldi(aminoethyl)glycine, di(octylaminoethyl)glycine and N-alkyl-N,N-dimethylammonium betaine.

A fluoroalkyl group-containing surfactant can exhibit its dispersing effects even when used in a small amount. Preferable examples of the fluoroalkyl group-containing anionic surfactant include C2-C10 fluoroalkyl carboxylic acid or a metal salt thereof, disodium perfluorooctane sulfonyl glutamate, sodium 3-[omegafluoroalkyl(C6-C11) oxy]-1-alkyl(C3-C4) sulfonate, sodium 3-[omegafluoroalkanoyl(C6-C8)-N-ethylamino]-1-propanesulfonate, fluoroalkyl(C11-C20) carboxylic acid or a metal salt thereof, perfluoroalkylcarboxylic acid (C7-C13) or a metal salt thereof, perfluoroalkyl(C4-C12) sulfonic acid or a metal salt thereof, perfluorooctanesulfonic acid diethanol amide, N-propyl-N-(2-hydroxyethyl)perfluorooctanesulfone amide, perfluoroalkyl(C6-C10) sulfoneamidepropyltrimethylammonium salt, a salt of perfluoroalkyl(C6-C10)-N-ethylsulfonylglycin and monoperfluoroalkyl(C6-C16) ethylphosphate.

Examples of commercial products of the dispersant include: SURFLON S-111, S-112, and S-113 (manufactured by Asahi Glass Co., Ltd.); FRORARD FC-93, FC-95, FC-98, and FC-129 (manufactured by Sumitomo 3M Ltd.); UNIDYNE DS-101, and DS-102 (manufactured by Daikin Industries, Ltd.); MEGAFAC F-110, F-120, F-113, F-191, F-812, and F-833 (manufactured by DIC Corporation); EFTOP EF-102, 103, 104, 105, 112, 123A, 123B, 306A, 501, 201, and 204 (manufactured by Tohchem Products Co., Ltd.); and FUTARGENT F-100, and F150 (manufactured by Neos Company Limited).

Examples of the cationic surfactant include an aliphatic primary, secondary or tertiary amine acid containing a fluoroalkyl group, aliphatic quaternary ammonium salt such as perfluoroalkyl(C6-C10) sulfoneamide propyl trimethyl ammonium salt, benzalkonium salt, benzetonium chloride, pyridinium salt, and imidazolinium salt. Examples of commercial products of the cationic surfactant include: SURFLON S-121 (manufactured by Asahi Glass Co., Ltd.); FRORARD FC-135 (manufactured by Sumitomo 3M Ltd.); UNIDYNE DS-202 (manufactured by Daikin Industries, Ltd.); MEGAFAC F-150, and F-824 (manufactured by DIC Corporation); EFTOP EF-132 (manufactured by Tohchem Products Co., Ltd.); and FUTARGENT F-300 (manufactured by Neos Company Limited).

Further, it is also possible to use an inorganic compound dispersant sparingly insoluble in water, such as tricalcium phosphate, calcium carbonate, titanium oxide, colloidal silica, and hydroxyapatite.

It is also possible to stabilize droplets of the dispersion with a polymeric protective colloid. Examples thereof include: acids such as acrylic acid, methacrylic acid, α-cyanoacrylic acid, α-cyanomethacrylic acid, itaconic acid, crotonic acid, fumaric acid, maleic acid and maleic anhydride; (meth)acryl monomer containing a hydroxyl group, such as β-hydroxyethyl acrylate, β-hydroxyethyl methacrylate, β-hydroxypropyl acrylate, γ-hydroxypropyl methacrylate, γ-hydroxypropyl acrylate, γ-hydroxypropyl methacrylate, 3-chloro-2-hydroxypropyl acrylate, 3-chloro-2-hydroxypropyl methacrylate, diethylene glycol monoacrylate, diethylene glycol monomethacrylate, glycerin monoacrylate, glycerin monomethacrylate, N-methylol acryl amide, and N-methylol methacryl amide; vinyl alcohol or ethers with vinyl alcohol, such as vinyl methyl ether, vinyl ethyl ether, and vinyl propyl ether; ester of vinyl alcohol and a compound containing a carboxyl group, such as vinyl acetate, vinyl propionate, and vinyl butyrate; acryl amide, methacryl amide, diacetone acryl amide or methylol compounds of the preceding amides; acid chlorides, such as acrylic acid chloride, and methacrylic acid chloride; a homopolymer or copolymer containing a nitrogen atom or its heterocycle, such as vinyl pyridine, vinyl pyrrolidone, vinyl imidazole, and ethylene imine; polyoxyethylenes, such as polyoxy ethylene, polyoxypropylene, polyoxy ethylene alkyl amine, polyoxypropylene alkyl amine, polyoxyethylene alkyl amide, polyoxypropylene alkyl amide, polyoxyethylene nonylphenyl ether, polyoxyethylene laurylphenyl ether, polyoxyethylene stearylphenyl ester, and polyoxyethylene nonylphenyl ester; and celluloses such as methyl cellulose, hydroxyethyl cellulose, and hydroxypropyl cellulose.

When an acid- or alkali-soluble compound such as calcium phosphate salt is used as a dispersion stabilizer, the calcium phosphate salt used is dissolved with an acid (e.g., hydrochloric acid), followed by washing with water, to thereby remove it from the formed fine particles. Also, the calcium phosphate salt may be removed through enzymatic decomposition.

When the dispersant is used, the dispersant may be left on the surface of the toner particles. However, it is preferable to wash and remove the dispersant after elongation reaction, cross-linking reaction, or both thereof, in terms of chargeability of the toner.

The reaction time for elongation, cross-linking, or both thereof is selected depending on the reactivity based on the combination of the isocyanate group structure contained in the prepolymer (A) and the amines (B), but it is typically from 10 minutes to 40 hours, and preferably from 2 hours to 24 hours. The reaction temperature is typically from 0° C. to 150° C., and preferably from 40° C. to 98° C. A publicly-known catalyst can be used according to necessity. Specific examples of the catalyst include dibutyl tin laurate and dioctyl tin laurate.

In order to remove the organic solvent from the obtained emulsified dispersion, a method of gradually raising the temperature of the entire system to evaporate and remove the organic solvent contained in the droplets completely. Alternatively, it is also possible to spray the emulsified dispersion to a dry atmosphere to completely remove the water-insoluble organic solvent contained in the droplets, to thereby form toner particles at the same time as evaporating and removing the aqueous dispersant. As the dry atmosphere to which the emulsified dispersion is sprayed, heated gas such as air, nitrogen, carbon dioxide, and combustion gas, and particularly air flows heated to a temperature equal to or higher than the boiling point of the highest boiling point solvent used are typically used. A treatment for a short period using a spray drier, belt drier, or rotary kiln is enough to achieve the intended quality. It is also possible to remove the organic solvent by blowing an air with a rotary evaporator or the like.

After this, the emulsified dispersion is subjected repeatedly to crude separation by centrifugal separation, washing in a washing tank, and drying with a hot air drier. Through these solvent removal and drying steps, the toner base can be obtained.

After this, it is preferable to provide an aging step. It is more preferable to age the toner base at from 30° C. to 55° C. (preferably from 40° C. to 50° C.) for from 0.5 hours to 36 hours (preferably, from 10 hours to 24 hours).

When the emulsification and dispersion have resulted in a wide particle size distribution, and this particle size distribution has been kept through the washing and drying steps, it is possible to adjust the particle size distribution by classification into a desired particle size distribution.

In the classification operation, fine particles are removed in a liquid with cyclone, decanter, or centrifugal separation. Needless to say, the classification operation may be performed after drying is performed and particles are obtained. However, it is preferable to perform classification in a liquid in terms of efficiency. The obtained unnecessary fine particles or coarse particles may be recovered to the kneading step again to be used for formation of particles. In this case, fine particles or coarse particles may be wet.

It is preferable to remove as much of the used dispersant as possible from the dispersion liquid. It is preferable to perform removal of the dispersant at the same time as the classification operation described above.

By mixing the obtained dried toner particles with other kinds of particles such as releasing agent fine particles, charge controlling agent fine particles, fluidizer fine particles, and colorant fine particles, or by applying a mechanical impact to mixture particles of those above, it is possible to fix and fuse them on the surface of composite particles to be obtained, and to prevent the other kinds of particles from detaching from the surface of the composite particles.

Examples of the specific method include a method of applying an impact to the mixture with a blade rotating at a high speed, and a method of adding the mixture to a high-speed air flow and accelerating the air flow to thereby make the particles collide on themselves or make the composite particles collide on a suitable impact board. Examples of the equipment include ANGMILL (manufactured by Hosokawa Micron Corporation), I-TYPE MILL (manufactured by Nippon Pneumatic Mfg. Co., Ltd.) modified to have a lower pulverizing air pressure, a hybridization system (manufactured by Nara Machinery Co., Ltd.), a kryptron system (manufactured by Kawasaki Heavy Industries, Ltd.), and an automatic mortar.

Finally, the toner is mixed with the external additives such as fine inorganic particles with a Henschel mixer or the like, and they are subjected to ultrasonic sieving or the like to remove coarse particles and obtain the final toner.

(Confirmation of Toner Core-Shell Structure)

When confirming the core-shell structure of the toner of the present invention, it is preferable to evaluate the core-shell structure based on a method using the following TEM (Transmission Electron Microscope). A core-shell structure is defined as a state of the toner surface being covered with a contrast component that is different from the toner interior.

First, about one spatularful of toner is embedded and hardened in an epoxy resin. The sample is exposed to a gas of ruthenium tetroxide, osmium tetroxide, or any other stain for 1 minute to 24 hours, to thereby stain the shell layer and the core interior distinguishably. The exposition time is adjusted appropriately according to the contrast observed. A cross-section of the sample is exposed with a knife, and an ultra-thin section (with a thickness of 200 nm) of the toner is manufactured with an ultramicrotome (ULTRACUT UCT manufactured by Leica Co., Ltd.). After this, the manufactured section is observed with a TEM (H7000 manufactured by Hitachi High-Technologies Corporation) at an accelerating voltage of 100 kV. Depending on the compositions of the shell layer and the core, they might be distinguishable without stains. In this case, they may be evaluated without stains. It is also possible to impart a contrast between the compositions by another means such as selective etching, and it is also preferable to perform TEM observation and shell layer evaluation after this kind of pretreatment.

(Thickness of Shell)

The thickness of the shell covering the toner is evaluated using the TEM observation image described above, and an image processing software program (e.g., LMEYE manufactured by Lasertec Corporation) The equivalent circle radius $R_S$ of the whole toner including the shell portion is obtained from the area of a toner cross-section including the shell portion. Next, the equivalent circle radium $R_C$ of the core portion is obtained from the area of a toner section excluding the shell portion. The thickness of the shell is calculated from $R_S-R_C$. Twenty particles are evaluated in the same manner, and their average is determined as the thickness of the shell of the toner.

(Two-Component Carrier)

When the toner of the present invention is used for a two-component carrier, the toner may be mixed with a magnetic carrier. The ratio of the carrier and the toner in the developer is preferably from 1 part by mass to 10 parts by mass of toner relative to 100 parts by mass of carrier.

The magnetic carrier may be any conventionally publicly known carrier such as iron powder, ferrite powder, magnetite powder, and magnetic resin carrier having a particle diameter of from about 20 μm to 200 μm.

Examples of a coating material include: polystyrene-based resin such as urea-formaldehyde resin, melamine resin, benzoguanamine resin, urea resin, polyamide resin, epoxy resin, acrylic resin, polymethyl methacrylate resin, polyacrylonitrile resin, polyvinyl acetate resin, polyvinyl alcohol resin, polyvinyl butyral resin, polystyrene resin, and styrene-acrylic copolymer resin; halogenated olefin rein such as polyvinyl chloride; polyester-based resin such as polyethylene terephthalate resin and polybutylene terephthalate resin; polycarbonate-based resin; polyethylene resin; polyvinyl fluoride resin; polyvinylidene fluoride resin, polytrifluoroethylene resin; polyhexafluoropropylene resin; copolymer of vinylidene fluoride and acrylic monomer; copolymer of vinylidene fluoride and vinyl fluoride; fluoroterpolymer such as terpolymer of tetrafluoroethylene, vinylidene fluoride, and a non-fluoromonomer; and silicone resin.

It is also possible to add en electro-conductive powder or the like to the coating resin, according to necessity. Examples of usable electro-conductive powders include metal powder, carbon black, titanium oxide, tin oxide, zinc oxide, etc.

The average particle diameter of these electro-conductive powders is preferably 1 μm or less. When the average particle diameter is greater than 1 μm, it will be difficult to control electric resistance.

The toner of the present invention can also be used as a one-component magnetic toner or non-magnetic toner free from carrier.

EXAMPLES

The present invention will be explained more specifically below with Examples and Comparative Examples. The present invention is not to be limited to these Examples. Note that "part" and "%" in the Examples represent "part by mass" and "% by mass" unless otherwise specified.

Physical properties of the toner of each of Examples and Comparative Examples measured according to the method described above are collectively shown in Tables 1-1 and 1-2.

Example 1

~Synthesis of Fine Resin Particle Emulsion~

A reaction vessel equipped with a stirring bar and a thermometer was charged with water (683 parts), sodium salt of methacrylic acid-ethylene oxide adduct sulfate (ELEMINOL RS-30 manufactured by Sanyo Chemical Industries, Ltd.) (11 parts), polylactic acid (10 parts), styrene (60 parts), methacrylic acid (100 parts), butyl acrylate (70 parts), and ammonium persulfate (1 part), and they were stirred at 4,000 rpm for 45 minutes, which resulted in a white emulsion. The system was heated until the internal temperature became 75° C., and the white emulsion was reacted for 1 hour. A 1% ammonium persulfate aqueous solution (30 parts) was further added thereto, and the resultant was aged at 75° C. for 1 hour, to thereby obtain an aqueous dispersion liquid of vinyl-based resin (copolymer of styrene/methacrylic acid/butyl acrylate/sodium salt of methacrylic acid-ethylene oxide adduct sulfate) [Fine Particle Dispersion Liquid 1].

~Preparation of Aqueous Phase~

Water (963 parts), [Fine Particle Dispersion Liquid 1] (110 parts), a 48.3% sodium dodecyldiphenyletherdisulfonate aqueous solution (ELEMINOL MON-7 manufactured by Sanyo Chemical Industries Ltd.) (37 parts), and ethyl acetate (90 parts) were mixed and stirred, to thereby obtain an opaque white liquid. This was [Aqueous Phase 1].

~Synthesis of Non-Crystalline Intermediate Polyester~

A reaction vessel equipped with a cooling pipe, a stirrer, and a nitrogen introducing pipe was charged with bisphenol A-ethylene oxide 2 mol adduct (200 parts), bisphenol A-propylene oxide 2 mol adduct (563 parts), terephthalic acid (283 parts), trimellitic anhydride (22 parts), and dibutyltin oxide (2 parts). They were reacted at normal pressure at 230° C. for 7 hours, and further reacted at reduced pressure of from 10 mmHg to 15 mmHg for 5 hours, to thereby obtain [Non-Crystalline Intermediate Polyester 1].

Next, a reaction vessel equipped with a cooling pipe, a stirrer, and a nitrogen introducing pipe was charged with [Non-Crystalline Intermediate Polyester 1] (410 parts), isophorone diisocyanate (89 parts), and ethyl acetate (500 parts), and they were reacted at 100° C. for 5 hours, to thereby obtain [Prepolymer 1].

~Synthesis of Ketimine Compound~

A reaction vessel equipped with a stirring bar and a thermometer was charged with isophorone diamine (170 parts) and methyl ethyl ketone (75 parts), and they were reacted at 45° C. for 5 hours and a half, to thereby obtain [Ketimine Compound 1].

~Synthesis of Crystalline Polyester~

A reaction vessel equipped with a cooling pipe, a stirrer, and a nitrogen introducing pipe was charged with 1,6-hexanediol (1,200 parts), decanedioic acid (1,200 parts), and dibutyltin oxide as a catalyst (0.4 parts), and after this, the air in the vessel was purged with a nitrogen gas under a depressurization operation to produce a inert atmosphere. The materials were stirred with mechanical stirring at 180 rpm for 4 hours. After this, the materials were stirred for 1.5 hours while gradually raising the temperature up to 210° C. under reduced pressure. Then, when the materials became viscous, they were air-cooled to terminate the reaction, to thereby obtain [Crystalline Polyester 1].

~Preparation of Oil Phase~

A vessel equipped with a stirring bar and a thermometer was charged with paraffin wax (melting point: 90° C.) (120 parts), [Crystalline Polyester Resin 1] (446 parts), and ethyl acetate (1,894 parts). While being stirred, the materials were warmed to 80° C., retained at 80° C. for 5 hours, and then cooled to 30° C. in 1 hour. Next, the vessel was charged with a cyan pigment (C.I. Pigment blue 15:3) (250 parts), and ethyl acetate (1,000 parts), and the resultant was mixed for 1 hour, to thereby obtain [Material Dissolved Liquid 1].

[Material Dissolved Liquid 1] (1,324 parts) was changed to another vessel, and subjected to a beads mill (ULTRA VISCOMILL manufactured by Imex Co., Ltd.) at a liquid delivering speed of 1 kg/hr, at a disk peripheral velocity of 6 m/second, with 0.5 mm-zirconia beads packed to 80% by volume, and for 5 passes, to disperse the pigment and wax, to thereby obtain [Pigment/Wax Dispersion Liquid 1].

~Emulsification to Desolventization~

A vessel was charged with [Pigment/Wax Dispersion Liquid 1] (375 parts), [Prepolymer 1] (500 parts), and [Ketimine Compound 1] (15 parts), and the materials were mixed with a TK homomixer (manufactured by Primix Corporation) at 5,000 rpm for 5 minutes. After this, [Aqueous Phase 1] (1,200 parts) was added to the vessel, and the resultant was mixed with a TK homomixer at 10,000 rpm for 1.5 hours, to thereby obtain [Emulsified Slurry 1].

A vessel equipped with a stirrer and a thermometer was charged with [Emulsified Slurry 1], and the slurry was desolventized at 30° C. for 8 hours. After this, the resultant was aged at 40° C. for 72 hours, to thereby obtain [Dispersed Slurry 1].

~Washing to Drying~

[Dispersed Slurry 1] was filtered at reduced pressure, and subjected to the following series of washing process.

That is, ion-exchanged water (100 parts) was added to the obtained filtration cake, and they were mixed with a TK homomixer (at 12,000 rpm for 10 minutes) and then filtered. Then, 10% hydrochloric acid (100 parts) was added to the obtained filtration cake, and they were mixed with a TK homomixer (at 12,000 rpm for 10 minutes) and then filtered. Then, an operation of adding ion-exchanged water (300 parts) to the obtained filtration cake, mixing them with a TK homomixer (at 12,000 rpm for 10 minutes), and then filtering the mixture was repeated twice, to thereby obtain [Filtration Cake 1].

This [Filtration Cake 1] was dried with an air-circulating drier at 45° C. for 48 hours, sieved through a mesh having a mesh size of 75 μm, to thereby obtain [Toner Base Particles 1].

Next, [Toner Base Particles 1] (100 parts) and hydrophobized silica having a particle diameter of 13 nm (1 part) were mixed with a Henschel mixer, to thereby obtain [Toner 1]. The thickness of the shell was 10 nm.

Example 2

[Toner 2] was obtained in the same manner as Example 1, except that the following [Fine Particle Dispersion Liquid 2] was used as the fine particle dispersion liquid. The thickness of the shell was 30 nm.

~Synthesis of Fine Resin Particle Emulsion~

A reaction vessel equipped with a stirring bar and a thermometer was charged with water (683 parts), sodium salt of methacrylic acid-ethylene oxide adduct sulfate (ELEMINOL RS-30 manufactured by Sanyo Chemical Industries, Ltd.) (11 parts), polylactic acid (10 parts), styrene (60 parts), methacrylic acid (100 parts), butyl acrylate (70 parts), and ammonium persulfate (1 part). The materials were stirred at 4,000 rpm for 15 minutes, and after this, stirred at 400 rpm for 30 minutes, to thereby obtain a white emulsion. The system was heated until the internal temperature was raised to 75° C., and the white emulsion was reacted for 4 hours. A 1% ammonium persulfate aqueous solution (30 parts) was further added thereto, and the resultant was aged at 75° C. for 6 hours, to thereby obtain an aqueous dispersion liquid of a vinyl-based resin (copolymer of styrene/methacrylic acid/butyl acrylate/sodium salt of methacrylic acid-ethylene oxide adduct sulfate) [Fine Particle Dispersion Liquid 2].

Example 3

[Toner 3] was obtained in the same manner as Example 1, except that the following [Material Dissolved Liquid 3] was used as the material dissolved liquid. The thickness of the shell was 9 nm.

~Preparation of Oil Phase~

A vessel equipped with a stirring bar and a thermometer was charged with paraffin wax (melting point: 90° C.) (120 parts), [Crystalline Polyester Resin 1] (190 parts), and ethyl acetate (1,894 parts). While being stirred, the materials were warmed to 80° C., retained at 80° C. for 5 hours, and then cooled to 30° C. in 1 hour. Next, the vessel was charged with a cyan pigment (C.I. Pigment blue 15:3) (250 parts) and ethyl acetate (1,000 parts), and the resultant was mixed for 1 hour, to thereby obtain [Material Dissolved Liquid 3].

A pigment/wax dispersion liquid, an emulsified slurry, a dispersed slurry, a filtration cake, and toner base particles obtained with the use of [Material Dissolved Liquid 3] were referred to as [Pigment/Wax Dispersion Liquid 3], [Emulsified Slurry 3], [Dispersed Slurry 3], [Filtration Cake 3], and [Toner Base Particles 3], respectively.

Example 4

[Toner 4] was obtained in the same manner as Example 3, except that the following [Filtration Cake 4] was used as base particles. This toner did not have a shell structure.

~Washing to Drying~

[Dispersed Slurry 3] (100 parts) was filtered under reduced pressure, and subjected to the following series of washing process.

That is, ion-exchanged water (100 parts) was added to the obtained filtration cake, and they were mixed with a TK homomixer (at 12,000 rpm for 10 minutes) and then filtered. Then, 30% sodium hydroxide aqueous solution (100 parts) was added to the obtained filtration cake, and they were mixed with a TK homomixer (at 12,000 rpm for 1 hour) while being heated to 60° C., and then filtered at normal temperature at reduced pressure. Then, 10% hydrochloric acid (100 parts) was added to the obtained filtration cake, and they were mixed with a TK homomixer (at 12,000 rpm for 10 minutes), and then filtered. Then, an operation of adding ion-exchanged water (300 parts) to the obtained filtration cake, mixing them with a TK homomixer (at 12,000 rpm for 10 minutes), and then filtering the mixture was repeated twice, to thereby obtain [Filtration Cake 4].

Example 5

[Toner 5] was obtained in the same manner as Example 1, except that the following [Material Dissolved Liquid 5] was used as the material dissolved liquid. The thickness of the shell was 12 nm.

~Preparation of Oil Phase~

A vessel equipped with a stirring bar and a thermometer was charged with paraffin wax (melting point: 90° C.) (120 parts), [Crystalline Polyester Resin 1] (70 parts), and ethyl acetate (1,894 parts). While being stirred, the materials were warmed to 80° C. and retained at the temperature for 30 minutes, cooled to 50° C. in 1 hour and retained at the temperature for 12 hours, and then cooled to 30° C. in 1 hour. Next, the vessel was charged with a cyan pigment (C.I. Pigment blue 15:3) (250 parts) and ethyl acetate (1,000 parts), and the resultant was mixed for 1 hour, to thereby obtain [Material Dissolved Liquid 5].

A pigment/wax dispersion liquid, an emulsified slurry, a dispersed slurry, a filtration cake, and toner base particles obtained with the use of [Material Dissolved Liquid 5] were referred to as [Pigment/Wax Dispersion Liquid 5], [Emulsified Slurry 5], [Dispersed Slurry 5], [Filtration Cake 5], and [Toner Base Particles 5], respectively.

Example 6

[Toner 6] was obtained in the same manner as Example 5, except that the following [Filtration Cake 6] was used. This toner did not have a shell structure.

~Washing to Drying~

[Dispersed Slurry 5] (100 parts) was filtered under reduced pressure, and subjected to the following series of washing process.

That is, ion-exchanged water (100 parts) was added to the obtained filtration cake, and they were mixed with a TK homomixer (at 12,000 rpm for 10 minutes) and then filtered. Then, 30% sodium hydroxide aqueous solution (100 parts) was added to the obtained filtration cake, and they were mixed with a TK homomixer (at 12,000 rpm for 1 hour) while being heated to 60° C., and then filtered at normal temperature at reduced pressure. Then, 10% hydrochloric acid (100 parts) was added to the obtained filtration cake, and they were mixed with a TK homomixer (at 12,000 rpm for 10 minutes), and then filtered. Then, an operation of adding ion-exchanged water (300 parts) to the obtained filtration cake, mixing them with a TK homomixer (at 12,000 rpm for 10 minutes), and then filtering the mixture was repeated twice, to thereby obtain [Filtration Cake 6].

Example 7

[Toner 7] was obtained in the same manner as Example 1, except that the following [Fine Particle Dispersion Liquid 7] was used as the fine particle dispersion liquid. The thickness of the shell was 12 nm.

~Synthesis of Crystalline Polyester Resin for Fine Particles~

A 5 L four-necked flask equipped with a nitrogen introducing pipe, a dehydrating pipe, a stirrer, and a thermocouple was charged with 1,4-butanediol (25 mol), fumaric acid (23.75 mol), trimellitic anhydride (1.65 mol), and hydroquinone (5.3 g). The materials were reacted at 160° C. for 5 hours, then reacted at a raised temperature of 200° C. for 1 hour, and then reacted at 1.3 kPa for 1 hour, to thereby obtain [Crystalline Polyester Resin 7 for Fine Particles].

[Crystalline Polyester Resin 7 for Fine Particles] (20 parts) was added to ethyl acetate (100 parts), and they were stirred at 70° C. for 30 minutes, to be turned to a transparent molten state. This molten liquid was quenched to segregate a crystal. The molten liquid with the segregated crystal was subjected to dispersion with a sand mill for 10 hours, to make the crystal more minute fine particles. This dispersion liquid was vacuum-dried at 30° C., to thereby obtain [Fine Resin Particles 7].

~Synthesis of Resin Fine Particle Emulsion~

A reaction vessel equipped with a stirring bar and a thermometer was charged with [Fine Resin Particles 7] (276 parts), water (683 parts), and sodium salt of methacrylic acid-ethylene oxide adduct sulfate (ELEMINOL RS-30 manufactured by Sanyo Chemical Industries, Ltd.) (11 parts), and the materials were stirred under room temperature at 400 rpm for 30 minutes. The same vessel was charged with styrene (83 parts), methacrylic acid (83 parts), butyl acrylate (110 parts), and ammonium persulfate (1 part), and the resultant was stirred at 400 rpm for 1 minutes, which resulted in a white emulsion. The system was heated until the internal temperature was raised to 75° C., and the white emulsion was reacted for 5 hours. A 1% ammonium persulfate aqueous solution (30 parts) was further added thereto, and the resultant was aged at 75° C. for 5 hours, to thereby obtain [Fine Particle Dispersion Liquid 7].

Example 8

[Toner 8] was obtained in the same manner as Example 7, except that the following [Fine Particle Dispersion Liquid 8] was used as the fine particle dispersion liquid. The thickness of the shell was 42 nm.

[Crystalline Polyester Resin 7 for Fine Particles] (20 parts) synthesized in Example 7 was added to ethyl acetate (100 parts), and they were stirred at 70° C. for 30 minutes, to be turned to a transparent molten state. This molten liquid was quenched to segregate a crystal. The molten liquid with the segregated crystal was subjected to dispersion with a sand mill for 3 hours, to make the crystal more minute fine particles. This dispersion liquid was vacuum-dried at 30° C., to thereby obtain [Fine Resin Particles 8].

~Synthesis of Fine Resin Particle Emulsion~

A reaction vessel equipped with a stirring bar and a thermometer was charged with [Fine Resin Particles 8] (276 parts), water (683 parts), and sodium salt of methacrylic acid-ethylene oxide adduct sulfate (ELEMINOL RS-30 manufactured by Sanyo Chemical Industries, Ltd.) (11 parts), and the materials were stirred at room temperature at 400 rpm for 30 minutes. The same vessel was charged with styrene (83 parts), methacrylic acid (83 parts), butyl acrylate (110 parts), and ammonium persulfate (1 part), and the resultant was stirred at 400 rpm for 15 minutes, which resulted in a white emulsion. The system was heated until the internal temperature was raised to 75° C., and the white emulsion was reacted for 5 hours. A 1% ammonium persulfate aqueous solution (30 parts) was further added thereto, aged at 75° C. for 5 hours, to thereby obtain [Fine Particle Dispersion Liquid 8].

Example 9

~Manufacture of Urethane-Modified Crystalline Polyester Resin~

A reaction tank equipped with a cooling pipe, a stirrer, and a nitrogen introducing pipe was charged with sebacic acid (202 parts) (1.00 mol), adipic acid (15 parts) (0.10 mol), 1,6-hexanediol (177 parts) (1.50 mol), and tetrabutoxytitanate as a condensation catalyst (0.5 parts). The materials were reacted under nitrogen stream at 180° C. for 8 hours, while distilling away water to be produced. Next, while the temperature was gradually raised up to 220° C., the materials were reacted for 4 hours while distilling away water to be produced and 1,6-hexanediol. The materials were further reacted at reduced pressure of from 5 mmHg to 20 mmHg until Mw reached about 12,000, to thereby obtain [Crystalline Polyester Resin 9].

Then, the obtained [Crystalline Polyester Resin 9] was changed to a reaction tank equipped with a cooling pipe, a stirrer, and a nitrogen introducing pipe. Ethyl acetate (400 parts) and 4,4'-diphenyl methane diisocyanate (MDI) (30 parts) (0.12 mol) were added thereto. The materials were reacted under nitrogen stream at 70° C. for 4 hours and a half. Then, ethyl acetate was distilled away under reduced pressure, to thereby obtain [Urethane-Modified Crystalline Polyester Resin 9].

~Manufacture of Non-Crystalline Resin~

A reaction tank equipped with a cooling pipe, a stirrer, and a nitrogen introducing pipe was charged with bisphenol A-EO 2 mol adduct (222 parts), bisphenol A-PO 2 mol adduct (129 parts), isophthalic acid (166 parts), and tetrabutoxy titanate (0.5 parts), and the materials were reacted under nitrogen stream at 230° C. at normal pressure for 8 hours, while distilling away water to be produced. Next, the materials were reacted at reduced pressure of from 5 mmHg to 20 mmHg, and cooled to 180° C. when the acid value became 2 mgKOH/g. Then, trimellitic anhydride (35 parts) was added thereto, and the resultant was reacted at normal pressure for 3 hours, to thereby obtain [Non-Crystalline Resin 9].

~Manufacture of Graft Polymer~

A reaction vessel equipped with a stirring bar and a thermometer was charged with xylene (480 parts) and low molecular weight polyethylene (SUN WAX LEL-400 manufactured by Sanyo Chemical Industries, Ltd., softening point of 128° C.) (100 parts), and the materials were dissolved sufficiently. Then, the vessel was purged with nitrogen. After this, a mixture solution of styrene (740 parts), acrylonitrile (100 parts), butyl acrylate (60 parts), di-t-butylperoxyhexahydroterephthalate (36 parts), and xylene (100 parts) was dropped into the vessel at 170° C. for 3 hours to promote polymerization of the materials, and the resultant was retained at this temperature for 30 minutes. Then, the resultant was desolventized, to thereby synthesize [Graft Polymer].

~Preparation of Wax Dispersion Liquid~

A vessel equipped with a stirring bar and a thermometer was charged with paraffin wax (hydrocarbon-based wax HNP-manufactured by Nippon Seiro Co., Ltd., melting point of 75° C., and SP value of 8.8) (50 parts), [Graft Polymer] (30 parts), and ethyl acetate (420 parts). While being stirred, the materials were warmed to 80° C., retained at 80° C. for 5 hours, after this, cooled to 30° C. in 1 hour, and then subjected to dispersion with a beads mill (ULTRA VISCOMILL manufactured by Imex Co., Ltd.) at a liquid delivering speed of 1 kg/hr, at a disk peripheral velocity of 6 m/second, with 0.5 mm zirconia beads packed to 80% by volume, and for 3 passes, to thereby obtain [Wax Dispersion Liquid].

~Preparation of Oil Phase~

A vessel equipped with a thermometer and a stirrer was charged with [Urethane-Modified Crystalline Polyester Resin 9] (33 parts), and such an amount of ethyl acetate that would result in a solid content concentration of 50%, and they were heated to equal to or higher than the melting point of the resin, and dissolved well. A 50% ethyl acetate solution of [Non-Crystalline Resin 9] (100 parts), [Wax Dispersion Liquid] (60 parts), and then a cyan pigment (C.I. Pigment blue 15:3) (8 parts) were added thereto, and the resultant was stirred at 50° C. with a TK homomixer (manufactured by Primix Corporation) at a 5,000 rpm, to be uniformly dissolved and dispersed, to thereby obtain [Pigment/Wax Dispersion Liquid 9]. [Pigment/Wax Dispersion Liquid 9] was retained in a vessel so as to be kept at a temperature of 50° C., and used within 5 hours from the production, so as not to be crystallized.

~Preparation of Aqueous Solution~

Water (990 parts), [Fine Particle Dispersion Liquid 1] (100 parts), a 48.5% aqueous solution of sodium dodecyldiphenyletherdisulfonate (ELEMINOL MON-7 manufactured by Sanyo Chemical Industries, Ltd.) (37 parts), and ethyl acetate (107 parts) were mixed and stirred, to thereby obtain [Aqueous Phase 9].

~Manufacture of Toner~

Another vessel equipped with a stirrer and a thermometer was charged with [Aqueous Phase 9] (520 parts), and heated to 40° C. [Aqueous Phase 9] retained at from 40° C. to 50° C. was stirred with a TK homomixer (manufactured by Primix Corporation) at 13,000 rpm, while adding thereto [Pigment/Wax Dispersion Liquid 9] (260 parts) retained at 50° C. as above, to emulsify the materials for 1 minute, to thereby obtain [Emulsified Slurry 9]. Next, a vessel equipped with a stirrer and a thermometer was charged with [Emulsified Slurry 9], and it was desolventized at 60° C. for 6 hours, to thereby obtain [Dispersed Slurry 9].

This [Dispersed Slurry 9] was filtered at reduced pressure, and subjected to the following series of washing process.

That is, ion-exchanged water (100 parts) was added to the obtained filtration cake, and they were mixed with a TK homomixer (at 6,000 rpm for 5 minutes) and then filtered. Then, 10% hydrochloric acid (100 parts) was added to the obtained filtration cake, and they were mixed with a TK homomixer (at 6,000 rpm for 5 minutes) and then filtered. Then, an operation of adding ion-exchanged water (300 parts) to the obtained filtration cake, mixing them with a TK homomixer (at 6,000 rpm for 5 minutes), and then filtering the mixture was repeated twice, to thereby obtain [Filtration Cake 9].

This [Filtration Cake 9] was dried with an air-circulating drier at 45° C. for 48 hours, sieved through a mesh having a mesh size of 75 μm, to thereby obtain [Toner Base Particles 9].

The obtained [Toner Base Particles 9] (100 parts) and hydrophobized silica (1 part) having a particle diameter of 13 nm were mixed with a Henschel mixer, to thereby obtain [Toner 9]. The thickness of the shell was 13 nm.

Example 10

[Toner 10] was obtained in the same manner as Example 9, except that [Fine Particle Dispersion Liquid 2] was used as the fine particle dispersion liquid. The thickness of the shell was 32 nm.

Example 11

[Toner 11] was obtained in the same manner as Example 9, except that the following [Pigment/Wax Dispersion Liquid 11] was used as the pigment/wax dispersion liquid. The thickness of the shell was 11 nm.

~Preparation of Oil Phase~

A vessel equipped with a thermometer and a stirrer was charged with [Urethane-Modified Crystalline Polyester Resin 9] (23 parts) and such an amount of ethyl acetate that would result in a solid content concentration of 50%. The materials were heated to equal to or higher than the melting point of the resin, and dissolved well. A 50% ethyl acetate solution of [Non-Crystalline Resin 9] (110 parts), [Releasing Agent Dispersion Liquid] (60 parts), and then a cyan pigment (C.I. Pigment blue 15:3) (8 parts) were added thereto, and the resultant was stirred at 50° C. with a TK homomixer (manufactured by Primix Corporation) at 5,000 rpm to be dissolved and dispersed uniformly, to thereby obtain [Pigment/Wax Dispersion Liquid 11]. [Pigment/Wax Dispersion Liquid 11] was retained in a vessel so as to be kept at a temperature of 50° C., and used within 5 hours from the production, so as not to be crystallized.

An emulsified slurry, a dispersed slurry, a filtration cake, and toner base particles obtained with the use of [Pigment/Wax Dispersion Liquid 11] were referred to as [Emulsified Slurry 11], [Dispersed Slurry 11], [Filtration Cake 11], and [Toner Base Particles 11], respectively.

Example 12

[Toner 12] was obtained in the sane manner as Example 11, except that [Fine Particle Dispersion Liquid 2] was used as the fine particle dispersion liquid. The thickness of the shell was 30 nm.

Example 13

[Toner 13] was obtained in the same manner as Example 9, except that the following [Pigment/Wax Dispersion Liquid 13] was used as the pigment/wax dispersion liquid. The thickness of the shell was 10 nm.

~Preparation of Oil Phase~

A vessel equipped with a thermometer and a stirrer was charged with [Urethane-Modified Crystalline Polyester Resin 9] (15 parts), and such an amount of ethyl acetate that would result in a solid content concentration of 50%, and they were heated to equal to or higher than the melting point of the resin, and dissolved well. A 50% ethyl acetate solution of [Non-Crystalline Resin 9] (120 parts), [Releasing Agent Dispersion Liquid] (60 parts), and then a cyan pigment (C.I. Pigment blue 15:3) (8 parts) were added thereto, and the resultant was stirred at 50° C. with a TK homomixer (manufactured by Primix Corporation) at a 5,000 rpm, to be uniformly dissolved and dispersed, to thereby obtain [Pigment/Wax Dispersion Liquid 13]. [Pigment/Wax Dispersion Liquid 13] was retained in a vessel so as to be kept at a temperature of 50° C., and used within 5 hours from the production, so as not to be crystallized.

An emulsified slurry, a dispersed slurry, a filtration cake, and toner base particles obtained with the use of [Pigment/Wax Dispersion Liquid 13] were referred to as [Emulsified Slurry 13], [Dispersed Slurry 13], [Filtration Cake 13], and [Toner Base Particles 13], respectively.

Example 14

[Toner 14] was obtained in the same manner as Example 13, except that the following [Filtration Cake 14] was used as the filtration cake. This toner did not have a shell structure.

~Manufacture of Toner~

Another vessel equipped with a stirrer and a thermometer was charged with [Aqueous Phase 9] (520 parts), and it was heated to 40° C. [Aqueous Phase 9] retained at from 40° C. to 50° C. was stirred with a TK homomixer (manufactured by Primix Corporation) at 13,000 rpm, while adding thereto [Pigment/Wax Dispersion Liquid 13] (260 parts) retained at 50° C. as above, to emulsify the materials for 1 minute, to thereby obtain [Emulsified Slurry 13]. Next, a vessel equipped with a stirrer and a thermometer was charged with [Emulsified Slurry 13], and it was desolventized at 60° C. for 6 hours, to thereby obtain [Dispersed Slurry 13].

This [Dispersed Slurry 13] was filtered at reduced pressure, and subjected to the following series of washing process.

That is, ion-exchanged water (100 parts) was added to the obtained filtration cake, and they were mixed with a TK homomixer (at 6,000 rpm for 5 minutes) and then filtered. Then, 30% sodium hydroxide aqueous solution (100 parts) was added to the obtained filtration cake, and they were mixed with a TK homomixer (at 12,000 rpm for 1 hour) while being heated to 60° C., and then filtered at normal temperature at reduced pressure. Then, 10% hydrochloric acid (100 parts) was added to the obtained filtration cake, and they were mixed with a TK homomixer (at 6,000 rpm for 5 minutes), and then filtered. Then, an operation of adding ion-exchanged water (300 parts) to the obtained filtration cake, mixing them with a TK homomixer (at 6,000 rpm for 5 minutes), and then filtering the mixture was repeated twice, to thereby obtain [Filtration Cake 14].

Example 15

[Toner 15] was obtained in the same manner as Example 9, except that [Fine Particle Dispersion Liquid 8] was used as the fine particle dispersion liquid. The thickness of the shell was 40 nm.

Example 16

~Manufacture of Non-Crystalline Segment~

A 5 L four-necked flask equipped with a nitrogen introducing pipe, a dehydrating pipe, a stirrer, and a thermocouple was charged with propylene glycol as diol and dimethyl terephthalate as dicarboxylic acid such that the ratio of OH group to COOH group (OH/COOH) would be 1.2, and also with titanium tetraisopropoxide in an amount of 300 ppm relative to the mass of the monomers charged, and the materials were reacted while letting methanol to be produced flow out. They were reacted until they were finally warmed to 230° C. and the acid value of the resin became 5 mgKOH/g or less. After this, they were reacted at reduced pressure of from 20 mmHg to 30 mmHg for 4 hours, to thereby obtain [Non-Crystalline Segment 16], which was a linear non-crystalline polyester resin.

~Manufacture of Crystalline Segment A (Crystalline Polyester Resin A)~

A 5 L four-necked flask equipped with a nitrogen introducing pipe, a dehydrating pipe, a stirrer, and a thermocouple was charged with 1,4-butanediol as diol and sebacic acid as dicarboxylic acid such that the ratio of OH group to COOH group (OH/COOH) would be 1.1, and also with titanium tetraisopropoxide in an amount of 300 ppm relative to the mass of the monomers charged, and the materials were reacted while letting water to be produced flow out. They were reacted until they were finally warmed to 230° C. and the acid value of the resin became 5 mgKOH/g or less. After this, they were reacted at reduced pressure of 10 mmHg or less for 6 hours, to thereby obtain [Crystalline Segment A16], which was [Crystalline Polyester Resin A16].

~Manufacture of Crystalline Segment B (Crystalline Polyester Resin B)~

A 5 L four-necked flask equipped with a nitrogen introducing pipe, a dehydrating pipe, a stirrer, and a thermocouple was charged with 1,6-hexanediol as diol and sebacic acid as dicarboxylic acid such that the ratio of OH group to COOH group (OH/COOH) would be 1.15, and also with titanium tetraisopropoxide in an amount of 300 ppm relative to the mass of the monomers charged, and the materials were reacted while letting water to be produced flow out. They were reacted until they were finally warmed to 230° C., and the acid value of the resin became 5 mgKOH/g or less. After this, they were reacted at reduced pressure of 10 mmHg or less for 4 hours, to thereby obtain [Crystalline Segment B16], which was [Crystalline Polyester Resin B16].

~Manufacture of Block Copolymer Resin~

A 5 L four-necked flask equipped with a nitrogen introducing pipe, a dehydrating pipe, a stirrer, and a thermocouple was charged with [Non-Crystalline Segment 16] (1,450 g) and [Crystalline Segment A16] (550 g), and they were dried at 60° C. for 2 hours at reduced pressure of 10 mmHg. After nitrogen depressurization, ethyl acetate (2,000 g) dehydrated through molecular sieves 4 A was added thereto, and the resultant was dissolved under nitrogen stream until the materials became uniform. Next, 4,4'-diphenylmethanediisocyanate (132 g) was added to the system, and the resultant was stirred until the materials became uniform visibly. After this, tin 2-ethylhexanoate as a catalyst was added to the system in an amount of 100 ppm, and the resultant was warmed to 80° C. and reacted under reflux for 5 hours. Next, ethyl acetate was distilled away from the resultant at reduced pressure, to thereby obtain [Block Copolymer Resin 16].

~Manufacture of Wax Dispersion Liquid~

A reaction vessel equipped with a cooling pipe, a thermometer, and a stirrer was charged with paraffin wax [HNP-9 manufactured by Nippon Seiro Co., Ltd. (melting point: 75° C.)] (20 parts) and ethyl acetate (80 parts), and they were heated to 78° C. to be dissolved well, and while being stirred, cooled to 30° C. in 1 hour. Then, the resultant was subjected to wet pulverization with ULTRA VISCOMILL (manufactured by Imex Co., Ltd.), at a liquid delivering speed of 1.0 kg/hour, at a disk peripheral velocity of 10 m/second, with zirconia beads having a diameter of 0.5 mm packed to 80% by volume, and for 6 passes. Then, ethyl acetate was added thereto to adjust the solid content concentration of the resultant, to thereby obtain [Wax Dispersion Liquid 16] having a solid content concentration of 20%.

~Manufacture of Master Batch~

[Block Copolymer Resin 16] (100 parts), a cyan pigment (C.I. Pigment blue 15:3) (100 parts), and ion-exchanged water (30 parts) were mixed well, and kneaded with an open roll kneader (KNEADEX manufactured by Nippon Coke & Engineering. Co., Ltd.). The kneading was started from 90° C., and the temperature was then gradually lowered to 50° C., to thereby manufacture [Master Batch 16] in which the ratio between the resin and the pigment (mass ratio) was 1:1.

~Manufacture of Toner~

A vessel equipped with a thermometer and a stirrer was charged with [Block Copolymer Resin 16] (94 parts) and [Crystalline Segment B16] (4.7 parts), and ethyl acetate (81 parts), and they were heated to equal to or higher than the melting point of the resin to be dissolved well. [Wax Dispersion Liquid 16] (25 parts) and [Master Batch 16] (12 parts) were added thereto, and the resultant was stirred at 50° C. with a TK homomixer (manufactured by Primix Corporation) at 10,000 rpm to be dissolved and dispersed uniformly, to thereby obtain [Oil Phase 16]. [Oil Phase 16] was retained in a vessel so as to be kept at a temperature of 50° C.

Next, [Oil Phase 16] (50 parts) retained at 50° C. was added to [Fine Particle Dispersion Liquid 7] (100 parts), and they were mixed at from 45° C. to 48° C. with a TK homomixer (manufactured by Primix Corporation) at 12,000 rpm for 1 minute, to thereby obtain [Emulsified Slurry 16]. A vessel equipped with a stirrer and a thermometer was charged with [Emulsified Slurry 16], and it was desolventized at 50° C. for 2 hours, to thereby obtain [Dispersed Slurry 16].

This [Dispersed Slurry 16] (100 parts) was filtered at reduced pressure, and subjected to the following series of washing process.

That is, ion-exchanged water (100 parts) was added to the obtained filtration cake, and they were mixed with a TK homomixer (at 6,000 rpm for 5 minutes) and then filtered. A 10% sodium hydroxide aqueous solution (100 parts) was added to the obtained filtration cake, and they were mixed with a TK homomixer (at 6,000 rpm for 10 minutes) and then filtered at reduced pressure. Then, 10% hydrochloric acid (100 parts) was added to the obtained filtration cake, and they were mixed with a TK homomixer (at 6,000 rpm for 5 minutes) and then filtered. Then, an operation of adding ion-exchanged water (300 parts) to the obtained filtration cake, mixing them with a TK homomixer (at 6,000 rpm for 5 minutes) and then filtering the mixture was repeated twice, to thereby obtain [Filtration Cake 16].

Next, the obtained [Filtration Cake 16] was dried with an air-circulating drier at 45° C. for 48 hours, and then sieved through a mesh having a mesh size of 75 μm, to thereby obtain [Toner Base Particles 16].

Next, the obtained [Toner Base Particles 16] (100 parts) was mixed with hydrophobic silica (HDK-2000 manufactured by Wacker Chemie AG) (1.0 part) and titanium oxide (MT-150AI manufactured by Tayca Corp.) (0.3 parts) with a Henschel mixer, to thereby obtain [Toner 16]. The thickness of the shell was 40 nm.

Example 17

[Toner 17] was obtained in the same manner as Example 12, except that [Fine Particle Dispersion Liquid 7] was used as the fine particle dispersion liquid. The thickness of the shell was 10 nm.

Example 18

[Toner 18] was obtained in the same manner as Example 9, except that the following [Pigment/Wax Dispersion Liquid 18] was used as the pigment/wax dispersion liquid. The thickness of the shell was 12 nm.

~Preparation of Oil Phase~

A vessel equipped with a thermometer and a stirrer was charged with [Urethane-Modified Crystalline Polyester Resin 9] (20 parts) and such an amount of ethyl acetate that would result in a solid content concentration of 50%, and they were heated to equal to or higher than the melting point of the resin, to be dissolved well. A 50% ethyl acetate solution of [Non-Crystalline Resin 9] (110 parts) and [Releasing Agent Dispersion Liquid] (60 parts), and then a cyan pigment (C.I. Pigment blue 15:3) (8 parts) were added thereto, and the resultant was stirred at 50° C. with a TK homomixer (manufactured by Primix Corporation) at 5,000 rpm to be dissolved and dispersed uniformly, to thereby obtain [Pigment/Wax Dispersion Liquid 18]. [Pigment/Wax Dispersion Liquid 18] was retained in a vessel so as to be kept at 50° C., and used within 5 hours from the production so as not to be crystallized.

An emulsified slurry, a dispersed slurry, a filtration cake, and toner base particles obtained with the use of [Pigment/Wax Dispersion Liquid 18] were referred to as [Emulsified Slurry 18], [Dispersed Slurry 18], [Filtration Cake 18], and [Toner Base Particles 18], respectively.

Comparative Example 1

[Toner 1'] was obtained in the same manner as Example 1, except that the following [Filtration Cake 1'] was used as the filtration cake. This toner did not have a shell layer.

~Washing to Drying~

[Dispersed Slurry 1] (100 parts) was filtered at reduced pressure, and subjected to the following series of washing process.

That is, ion-exchanged water (100 parts) was added to the obtained filtration cake, and they were mixed with a TK homomixer (at 12,000 rpm for 10 minutes), and then filtered. A 30% sodium hydroxide aqueous solution (100 parts) was added to the obtained filtration cake, and they were mixed with a TK homomixer (at 12,000 for 1 hour) while being heated to 60° C., and then filtered at normal temperature at reduced pressure. Then, 10% hydrochloric acid (100 parts) was added to the obtained filtration cake, and they were mixed with a TK homomixer (at 12,000 rpm for 10 minutes), and then filtered. Then, an operation of adding ion-exchanged water (300 parts) to the obtained filtration cake, mixing them with a TK homomixer (at 12,000 for 10 minutes), and then filtering the mixture was repeated twice, to thereby obtain [Filtration Cake 1'].

Comparative Example 2

[Toner 2'] was obtained in the same manner as Example 3, except that [Fine Particle Dispersion Liquid 2] was used as the fine particle dispersion liquid. The thickness of the shell was 29 nm.

Comparative Example 3

[Toner 3'] was obtained in the same manner as Example 5, except that [Fine Particle Dispersion Liquid 2] was used as the fine particle dispersion liquid. The thickness of the shell was 29 nm.

Comparative Example 4

[Toner 4'] was obtained in the same manner as Example 9, except that the following [Filtration Cake 4'] was used as the filtration cake. This toner did not have a shell structure.

~Manufacture of Toner~

Another vessel equipped with a stirrer and a thermometer was charged with [Aqueous Phase 9] (520 parts) and it was heated to 40° C. [Aqueous Phase 9] retained at from 40° C. to 50° C. was stirred with a TK homomixer (manufactured by Primix Corporation) at 13,000 rpm, while adding thereto [Pigment/Wax Dispersion Liquid 9] (260 parts) retained at 50° C., to emulsify the materials for 1 minute, to thereby obtain [Emulsified Slurry 9]. Next, a vessel equipped with a stirrer and a thermometer was charged with [Emulsified Slurry 9], and it was desolventized at 60° C. for 6 hours, to thereby obtain [Dispersed Slurry 9].

This [Dispersed Slurry 9] was filtered at reduced pressure and subjected to the following series of washing process.

That is, ion-exchanged water (100 parts) was added to the obtained filtration cake, and they were mixed with a TK homomixer (at 6,000 rpm for 5 minutes), and then filtered. A 30% sodium hydrochloride aqueous solution (100 parts) was added to the obtained filtration cake, and they were mixed with a TK homomixer (at 12,000 rpm for 1 hour) while being heated to 60° C., and then filtered at normal temperature at reduced pressure. Then, 10% hydrochloric acid (100 parts) was added to the obtained filtration cake, and they were mixed with a TK homomixer (at 6,000 rpm for 5 minutes), and the filtered. Then, an operation of adding ion-exchanged water (300 parts) to the obtained filtration cake, mixing them with a TK homomixer (at 6,000 rpm for 5 minutes), and then filtering the mixture was repeated twice, to thereby obtain [Filtration Cake 4'].

Comparative Example 5

[Toner 5'] was obtained in the same manner as Example 11, except that the following [Filtration Cake 5'] was used as the filtration cake. This toner did not have a shell structure.

~Manufacture of Toner~

Another vessel equipped with a stirrer and a thermometer was charged with [Aqueous Phase 9] (520 parts) and it was heated to 40° C. [Aqueous Phase 9] retained at from 40° to 50° C. was stirred with a TK homomixer (manufactured by Primix Corporation) at 13,000 rpm, while adding thereto [Pigment/Wax Dispersion Liquid 11] (260 parts) retained at 50° C., to emulsify the materials for 1 minute, to thereby obtain [Emulsified Slurry 11]. Next, a vessel equipped with a stirrer and a thermometer was charged with [Emulsified Slurry 11], and it was desolventized at 60° C. for 6 hours, to thereby obtain [Dispersed Slurry 11].

This [Dispersed Slurry 11] was filtered at reduced pressure, and subjected to the following series of washing process.

That is, ion-exchanged water (100 parts) was added to the obtained filtration cake, and they were mixed with a TK homomixer (at 6,000 rpm for 5 minutes), and then filtered. A 30% sodium hydroxide aqueous solution (100 parts) was added to the obtained filtration cake, and they were mixed with a TK homomixer (at 12,000 rpm for 1 hour) while being heated to 60° C., and then filtered at normal temperature at reduced pressure. Then, 10% hydrochloric acid (100 parts) was added to the obtained filtration cake, and they were mixed with a TK homomixer (at 6,000 rpm for 5 minutes), and then filtered. Then, an operation of adding ion-exchanged water (300 parts) to the obtained filtration cake, mixing them with a TK homomixer (at 6,000 rpm for 5 minutes), and then filtering the mixture was repeated twice, to thereby obtain [Filtration Cake 5'].

Comparative Example 6

[Toner 6'] was obtained in the same manner as Example 13, except that [Fine Particle Dispersion Liquid 2] was used as the fine particle dispersion liquid. The thickness of the shell was 32 nm.

Comparative Example 7

[Toner 7'] was obtained in the same manner as Example 15, except that [Fine Particle Dispersion Liquid 7] was used as the fine particle dispersion liquid. The thickness of the shell was 11 nm.

Comparative Example 8

~Synthesis of Fine Resin Particle Emulsion~

A reaction vessel equipped with a stirring bar and a thermometer was charged with water (683 parts), sodium salt of methacrylic acid-ethylene oxide adduct sulfate (ELEMINOL RS-30 manufactured by Sanyo Sanyo Chemical Industries, Ltd.) (11 parts), polylactic acid (10 parts), styrene (60 parts), methacrylic acid (100 parts), butyl acrylate (70 parts), and ammonium persulfate (1 part), and they were stirred at 3,800 rpm for 30 minutes, which resulted in a white emulsion. The system was heated until the internal temperature became 75° C., and the while emulsion was reacted for 4 hours. A 1% ammonium persulfate aqueous solution (30 parts) was further added thereto, and the resultant was aged at 75° C. for 6 hours, to thereby obtain an aqueous dispersion liquid of a vinyl-based resin (copolymer of styrene/methacrylic acid/butyl acrylate/sodium salt of methacrylic aid-ethylene oxide adduct sulfate) [Fine Particle Dispersion Liquid 8'].

~Preparation of Aqueous Phase~

Water (990 parts), [Fine Particle Dispersion Liquid 8'] (83 parts), a 48.5% sodium dodecyldiphenyletherdisulfonate aqueous solution (ELEMINOL MON-7 manufactured by Sanyo Chemical Industries Ltd.) (37 parts), and ethyl acetate (90 parts) were mixed and stirred, to thereby obtain an opaque liquid. This was [Aqueous Phase 8'].

~Synthesis of Non-Crystalline Low Molecular Polyester~

A reaction vessel equipped with a cooling pipe, a stirrer, and a nitrogen introducing pipe was charged with bisphenol A-ethylene oxide 2 mol adduct (229 parts), bisphenol A-propylene oxide 3 mol adduct (339 parts), terephthalic acid (208 parts), adipic acid (80 parts), succinic acid (10 parts), and dibutyltin oxide (2 parts). They were reacted at normal pressure at 230° C. for 5 hours, and then further reacted at reduced pressure of from 10 mmHg to 15 mmHg for 5 hours. After this, trimellitic anhydride (35 parts) was added to the reaction vessel, and the resultant was reacted at 180° C. for 1 hour, to thereby obtain [Non-Crystalline Low Molecular Polyester 8'].

~Synthesis of Non-Crystalline Intermediate Polyester~

A reaction vessel equipped with a cooling pipe, a stirrer, and a nitrogen introducing pipe was charged with bisphenol A-ethylene oxide 2 mol adduct (682 parts), bisphenol A-propylene oxide 2 mol adduct (81 parts), terephthalic acid (283 parts), trimellitic anhydride (22 parts), and dibutyltin oxide (2 parts). They were reacted at normal pressure at 230° C. for 7 hours, and further reacted at reduced pressure of from 10 mmHg to 15 mmHg for 5 hours, to thereby obtain [Non-Crystalline Intermediate Polyester 8'].

Next, a reaction vessel equipped with a cooling pipe, a stirrer, and a nitrogen introducing pipe was charged with [Non-Crystalline Intermediate Polyester 8'] (410 parts), isophorone diisocyanate (89 parts), and ethyl acetate (500 parts), and they were reacted at 100° C. for 5 hours, to thereby obtain [Prepolymer 8'].

~Synthesis of Ketimine Compound~

A reaction vessel equipped with a stirring bar and a thermometer was charged with isophorone diamine (170 parts) and methyl ethyl ketone (75 parts), and they were reacted at 50° C. for 4 hours and a half to thereby obtain [Ketimine Compound 8'].

~Manufacture of Oil Phase~

A vessel equipped with a stirring bar and a thermometer was charged with [Non-Crystalline Low Molecular Polyester 8'] (740 parts), paraffin wax (melting point: 90° C.) (120 parts), [Crystalline Polyester Resin 1] (456 parts), and ethyl acetate (1,894 parts). While being stirred, they were warmed to 80° C., retained at 80° C. for 5 hours, and then cooled to 30° C. in 1 hour. Next, the vessel was charged with a cyan pigment (C.I. Pigment blue 15:3) (250 parts) and ethyl acetate (1,000 parts), and they were mixed for 1 hour, to thereby obtain [Material Dissolved Liquid 8'].

[Material Dissolved Liquid 8'] (1,324 parts) was changed to another vessel, and subjected to a beads mill (ULTRA VISCOMILL manufactured by Imex Co., Ltd.) at a liquid delivering speed of 1 kg/hr, at a disk peripheral velocity of 6 m/second, with 0.5 mm zirconia beads packed to 80% by volume, and for 5 passes, to disperse carbon black and wax, to thereby obtain [Pigment/Wax Dispersion Liquid 8'].

~Emulsification to Desolventization~

A vessel was charged with [Pigment/Wax Dispersion Liquid 8'] (749 parts), [Prepolymer 8'] (130 parts), and [Ketimine Compound 8'] (3.8 parts), and they were mixed with a TK homomixer (manufactured by Primix Corporation) at 5,000 rpm for 5 minutes. After this, [Aqueous Phase 8'] (1,200 parts) was added to the vessel, and the resultant was mixed with a TK homomixer at 10,000 rpm for 1.5 hours, to thereby obtain [Emulsified Slurry 8'].

A vessel equipped with a stirrer and a thermometer was charged with [Emulsified Slurry 8']. It was desolventized at 30° C. for 8 hours, and after this, aged at 40° C. for 72 hours, to thereby obtain [Dispersed Slurry 8'].

~Washing to Drying~

[Dispersed Slurry 8'] (100 parts) was filtered at reduced pressure, and then subjected to the following series of washing process.

That is, ion-exchanged water (100 parts) was added to the obtained filtration cake, and they were mixed with a TK homomixer (at 12,000 rpm for 10 minutes), and then filtered. A 10% sodium hydroxide aqueous solution (100 parts) was added to the obtained filtration cake, and they were mixed with a TK homomixer (at 12,000 rpm for 30 minutes), and then filtered at reduced pressure. Then, 10% hydrochloric acid (100 parts) was added to the obtained filtration cake, and they were mixed with a TK homomixer (at 12,000 rpm for 10 minutes), and then filtered. Then, an operation of adding ion-exchanged water (300 parts) to the obtained filtration cake, mixing them with a TK homomixer (at 12,000 rpm for 10 minutes), and then filtering the mixture was repeated twice, to thereby obtain [Filtration Cake 8'].

[Filtration Cake 8'] was dried with an air-circulating drier at 45° C. for 48 hours, and after this, sieved with a mesh having a mesh size of 75 μm, to thereby obtain [Toner Base Particles 8'].

After this, [Toner Base Particles 8'] (100 parts) and hydrophobized silica having a particle diameter of 13 nm (1 part) were mixed with a Henschel mixer, to thereby obtain [Toner 8']. The thickness of the shell was 52 nm.

Comparative Example 9

~Manufacture of Urethane-Modified Crystalline Polyester Resin~

A reaction tank equipped with a cooling pipe, a stirrer, and a nitrogen introducing pipe was charged with sebacic acid (202 parts) (1.00 mol), adipic acid (15 parts) (0.10 mol), 1,6-hexanediol (177 parts) (1.50 mol), and tetrabutoxy titanate as a condensation catalyst (0.5 parts). They were reacted under nitrogen stream at 180° C. for 8 hours, while distilling away water to be produced. Next, they were gradually warmed up to 220° C., reacted under nitrogen stream for 4 hours while distilling away water to be produced and 1,6-hexanediol, and then further reacted at reduced pressure of from 5 mmHg to 20 mmHg until Mw reached about 12,000, to thereby obtain [Crystalline Polyester Resin 9'].

Next, the obtained [Crystalline Polyester Resin 9'] was changed to a reaction tank equipped with a cooling pipe, a stirrer, and a nitrogen introducing pipe. Ethyl acetate (350 parts) and 4,4'-diphenylmethanediisocyanate (MDI) (30 parts) (0.12 mol) were added thereto, and the resultant was reacted under nitrogen stream at 80° C. for 5 hours. Next, ethyl acetate was distilled away from the resultant under reduced pressure, to thereby obtain [Urethane-Modified Crystalline Polyester Resin 9'].

~Manufacture of Non-Crystalline Resin~

A reaction tank equipped with a cooling pipe, a stirrer, and a nitrogen introducing pipe was charged with bisphenol A-EO 2 mol adduct (222 parts), bisphenol A-PO 2 mol adduct (129 parts), isophthalic acid (166 parts), and tetrabutoxy titanate (0.5 parts). They were reacted under nitrogen stream at 230° C. at normal pressure for 8 hours, while distilling away water to be produced. Next, they were reacted under reduced pressure of from 5 mmHg to 20 mmHg, and cooled to 180° C. when the acid value became 2 mgKOH/g. Trimellitic anhydride (35 parts) was added thereto, and the resultant was reacted at normal pressure for 3 hours, to thereby obtain [Non-Crystalline Resin 9'].

~Manufacture of Master Batch~

The materials indicated below were mixed with a Henschel mixer (manufactured by Mitsui Mining Co., Ltd.), and the obtained mixture was kneaded with two rolls. The kneading was started from of 90° C., and the temperature was then gradually lowered to 50° C. The obtained kneaded product was pulverized with a pulverizer (manufactured by Hosokawa Micron Corporation), to thereby obtain [Master Batch 9'].

| | |
|---|---|
| Urethane-modified crystalline polyester resin 9' | 100 parts |
| Cyan pigment (C.I. Pigment blue 15:3) | 100 parts |
| Ion-exchanged water | 50 parts |

~Manufacture of Oil Phase~

A vessel equipped with a thermometer and a stirrer was charged with [Urethane-Modified Crystalline Polyester Resin 9'] (72 parts) and such an amount of ethyl acetate that would result in a solid content concentration of 50%, and they were heated to equal to or higher than the melting point of the resin, to be dissolved well. An ethyl acetate solution of [Non-Crystalline Resin 9'] (40 parts), [Wax Dispersion Liquid] (60 parts), and [Master Batch 9'] (16 parts) were added thereto, and the resultant was stirred at 50° C. with a TK homomixer (manufactured by Primix Corporation) at 5,000 rpm, to be dissolved and dispersed uniformly, to thereby obtain [Pigment/Wax Dispersion Liquid 9']. [Pigment/Wax Dispersion Liquid 9'] was retained in a vessel so as to be kept at 50° C., and used within 5 hours from the manufacture so as not to be crystallized.

~Synthesis of Fine Resin Particle Emulsion~

A reaction vessel equipped with a stirring bar and a thermometer was charged with water (600 parts), styrene (120 parts), methacrylic acid (100 parts), butyl acrylate (45 parts), alkylallylsulfosuccinic acid sodium salt (ELEMINOL JS-2 manufactured by Sanyo Chemical Industries, Ltd.) (10 parts), and ammonium persulfate (1 part), and they were stirred at 400 rpm for 20 minutes, which resulted in a white emulsion. This white emulsion was heated until the internal temperature of the system became 75° C., and reacted for 6 hours. A 1% ammonium persulfate aqueous solution (30 parts) was further added thereto, and the resultant was aged at 75° C. for 6 hours, to thereby obtain [Fine Particle Dispersion Liquid 9'].

~Preparation of Aqueous Phase~

Water (990 parts), [Fine Particle Dispersion Liquid 9'] (83 parts), a 48.5% sodium dodecyldiphenyletherdisulfonate aqueous solution (ELEMINOL MON-7 manufactured by Sanyo Chemical Industries, Ltd.) (37 parts), and ethyl acetate (90 parts) were mixed and stirred, to thereby obtain [Aqueous Phase 9'].

Another vessel equipped with a stirrer and a thermometer was charged with [Aqueous Phase 9'] (520 parts), and it was heated to 40° C. [Aqueous Phase 9'] retained at from 40° C. to 50° C. was stirred with a TK homomixer (manufactured by Primix Corporation) at 13,000 rpm, while adding thereto [Pigment/Wax Solution Liquid 9'] (260 parts) retained at 50° C. as above, to emulsify the materials for 1 minute, to thereby obtain [Emulsified Slurry 9']. Next, a vessel equipped with a stirrer and a thermometer was charged with [Emulsified Slurry 9'], and it was desolventized at 60° C. for 6 hours, to thereby obtain [Dispersed Slurry 9'].

This [Dispersed Slurry 9'] was filtered at reduced pressure, and subjected to the following series of washing process.

That is, ion-exchanged water (100 parts) was added to the obtained filtration cake, and they were mixed with a TK homomixer (at 6,000 rpm for 5 minutes) and then filtered. A 10% sodium hydroxide aqueous solution (100 parts) was added to the obtained filtration cake, and they were mixed with a TK homomixer (at 6,000 rpm for 10 minutes), and then filtered at reduced pressure. Then, 10% hydrochloric acid (100 parts) was added to the obtained filtration cake, and they were mixed with a TK homomixer (at 6,000 rpm for 5 minutes), and then filtered. An operation of adding ion-exchanged water (300 parts) to the obtained filtration cake, mixing them with a TK homomixer (at 6,000 rpm for 5 minutes), and then filtering the mixture was repeated twice, to thereby obtain [Filtration Cake 9'].

The obtained [Filtration Cake 9'] was dried with an air-circulating drier at 45° C. for 48 hours, and after this, sieved with a mesh having a mesh size of 75 μm, to thereby manufacture [Toner Base Particles 9'].

The obtained [Toner Base Particles 9'] (100 parts) and hydrophobized silica having a particle diameter of 13 nm (1 part) were mixed with a Henschel mixer, to thereby obtain [Toner 9']. The thickness of the shell was 58 nm.

Comparative Example 10

~Preparation of Aqueous Phase~

Water (963 parts), [Fine Particle Dispersion Liquid 8'] (110 parts), a 48.3% sodium dodecyldiphenyletherdisulfonate aqueous solution (37 parts), and ethyl acetate (90 parts) were mixed and stirred, to thereby obtain opaque liquid. This was [Aqueous Phase 10'].

~Synthesis of Non-Crystalline Low Molecular Polyester~

A reaction vessel equipped with a cooling pipe, a stirrer, and a nitrogen introducing pipe was charged with bisphenol A-ethylene oxide 2 mol adduct (229 parts), bisphenol A-propylene oxide 3 mol adduct (339 parts), terephthalic acid (208 parts), adipic acid (80 parts), succinic acid (10 parts), and dibutyltin oxide (2 parts). They were reacted at normal pressure at 230° C. for 5 hours, and then further added at reduced pressure of from 10 mmHg to 15 mmHg for 5 hours. After this, trimellitic anhydride (35 parts) was added to the reaction vessel, and the resultant was reacted at 180° C. at normal pressure for 1 hour, to thereby obtain [Non-Crystalline Low Molecular Polyester 10'].

~Synthesis of Non-Crystalline Intermediate Polyester~

A reaction vessel equipped with a cooling pipe, a stirrer, and a nitrogen introducing pipe was charged with bisphenol A-ethylene oxide 2 mol adduct (682 parts), bisphenol A-propylene oxide 2 mol adduct (81 parts), terephthalic acid (283 parts), trimellitic anhydride (22 parts), and dibutyltin oxide (2 parts). They were reacted at normal pressure at 230° C. for 7 hours, and the further reacted at reduced pressure of from 10 mmHg to 15 mmHg for 5 hours, to thereby obtain [Non-Crystalline Intermediate Polyester 10'].

Next, a reaction vessel equipped with a cooling pipe, a stirrer, and a nitrogen introducing pipe was charged with [Non-Crystalline Intermediate Polyester 1] (410 parts), isophorone diisocyanate (89 parts), and ethyl acetate (500 parts), and they were reacted at 100° C. for 5 hours, to thereby obtain [Prepolymer 10'].

~Synthesis of Ketimine Compound~

A reaction vessel equipped with a stirring bar and a thermometer was charged with isophorone diamine (170 parts) and methyl ethyl ketone (75 parts), and they were reacted at 45° C. for 3 hours and a half, to thereby obtain [Ketimine Compound 10'].

~Manufacture of Oil Phase~

A vessel equipped with a stirring bar and a thermometer was charged with [Non-Crystalline Low Molecular Polyester 10'] (750 parts), paraffin wax (melting point: 90° C.) (120 parts), [Crystalline Polyester Resin 1] (446 parts), and ethyl acetate (1,894 parts). While being stirred, they were warmed to 80° C., retained at 80° C. for 5 hours, and then cooled to 30° C. in 1 hour. Next, the vessel was further charged with a cyan pigment (C.I. Pigment blue 15:3) (250 parts) and ethyl acetate (1,000 parts), and the resultant was mixed for 1 hour, to thereby obtain [Material Dissolved Liquid 10'].

[Material Dissolved Liquid 10'] (1,324 parts) was changed to another vessel, and subjected to a beads mill (ULTRA VISCOMILL manufactured by Imex Co., Ltd.) at a liquid delivering speed of 1 kg/hr, at a disk peripheral velocity of 6 m/second, with 0.5 mm zirconia beads packed to 80% by volume, and for 5 passes, to disperse carbon black and wax, to thereby obtain [Pigment/Wax Dispersion Liquid 10'].

~Emulsification to Desolventization~

A vessel was charged with [Pigment/Wax Dispersion Liquid 10'] (749 parts), [Prepolymer 10'] (120 parts), and [Ketimine Compound 10'] (3.5 parts), and they were mixed with at TK homomixer (manufactured by Primix Corporation) at 5,000 rpm for 5 minutes. After this, [Aqueous Phase 10'] (1,200 parts) was added to the vessel, and the resultant was mixed with a TK homomixer at 10,000 rpm for 1.5 hours, to thereby obtain [Emulsified Slurry 10'].

Next, a vessel equipped with a stirrer and a thermometer was charged with [Emulsified Slurry 10'], and it was desolventized at 30° C. for 8 hours, and after this aged at 40° C. for 72 hours, to thereby obtain [Dispersed Slurry 10'].

~Washing to Drying~

[Dispersed Slurry 10'] (100 parts) was filtered at reduced pressure, and then subjected to the following series of washing process.

That is, ion-exchanged water (100 parts) was added to the obtained filtration cake, and they were mixed with a TK homomixer (at 12,000 rpm for 10 minutes), and then filtered. A 10% sodium hydroxide aqueous solution (100 parts) was added to the obtained filtration cake, and they were mixed with a TK homomixer at (12,000 rpm for 30 minutes), and the filtered. Then, 10% hydrochloric acid (100 parts) was added to the obtained filtration cake, and they were mixed with a TK homomixer (at 12,000 rpm for 10 minutes), and then filtered. Then, an operation of adding ion-exchanged water (300 parts) to the obtained filtration cake, mixing them with a TK homomixer (at 12,000 rpm for 10 minutes), and then filtering the mixture was repeated twice, to thereby obtain [Filtration Cake 10'].

[Filtration Cake 10'] was dried with an air-circulating drier at 45° C. for 48 hours, and after this, sieved with a mesh having a mesh size of 75 μm, to thereby obtain [Toner Base Particles 10'].

After this, [Toner Base Particles 10'] (100 parts) and hydrophobized silica having a particle diameter of 13 nm (1 part) were mixed with a Henschel mixer, to thereby obtain [Toner 10']. The thickness of the shell was 46 nm.

Comparative Example 11

A reaction tank equipped with a cooling pipe, a stirrer, and a nitrogen introducing pipe was charged with sebacic acid (202 parts) (1.00 mol), adipic acid (15 parts) (0.10 mol), 1,6-hexanediol (177 parts) (1.50 mol), and tetrabutoxy titanate as a condensation catalyst (0.5 parts), and they were reacted under nitrogen stream at 180° C. for 8 hours, while distilling away water to be produced. Next, they were gradually warmed up to 220° C., reacted under nitrogen stream for 4 hours while distilling away water to be produced and 1,6-hexanediol, and further reacted at reduced pressure of from 5 mmHg to 20 mmHg until Mw reached 12,000, to thereby obtain [Crystalline Polyester Resin 11'].

Next, the obtained [Crystalline Polyester Resin 11'] was changed to a reaction tank equipped with a cooling pipe, a stirrer, and a nitrogen introducing pipe. Ethyl acetate (350 parts) and 4,4'-diphenylmethanediisocyanate (MDI) (25 parts) (0.10 mol) were added thereto, and the resultant was reacted under nitrogen stream at 80° C. for 5 hours. Next, ethyl acetate was distilled away from the resultant at reduced pressure, to thereby obtain [Urethane-Modified Crystalline Polyester Resin 11'].

~Manufacture of Non-Crystalline Resin~

A reaction tank equipped with a cooling pipe, a stirrer, and a nitrogen introducing pipe was charged with bisphenol A-EO 2 mol adduct (222 parts), bisphenol A-PO 2 mol adduct (129 parts), isophthalic acid (166 parts), and tetrabutoxy titanate (0.5 parts), and they were reacted under nitrogen stream at 230° C. at normal pressure four 8 hours, while distilling away water to be produced. Next, they were reacted at reduced pressure of from 5 mmHg to 20 mmHg, and cooled to 180° C. when the acid value became 2. Trimellitic anhydride (35 parts) was added thereto, and the resultant was reacted at normal pressure for 3 hours, to thereby obtain [Non-Crystalline Polyester 11'].

~Manufacture of Master Batch~

The materials indicated below were mixed with a Henschel mixer (manufactured by Mitsui Mining Co., Ltd.), and the obtained mixture was kneaded with two rolls. The kneading was started from 90° C., and after this, the temperature was gradually lowered to 50° C. The obtained kneaded product was pulverized with a pulverizer (manufactured by Hosokawa Micron Corporation), to thereby obtain [Master Batch 11'].

| | |
|---|---|
| Urethane-Modified Crystalline Polyester Resin 11' | 100 parts |
| Cyan pigment (C.I. Pigment blue 15:3) | 100 parts |
| Ion-exchanged water | 50 parts |

~Manufacture of Oil Phase~

A vessel equipped with a thermometer and a stirrer was charged with [Urethane-Modified Crystalline Polyester Resin 11'] (72 parts) and such an amount of ethyl acetate that would result in a solid content concentration of 50%, and they were heated to equal to or higher than the melting point of the resin, to be dissolved well. A 50% ethyl acetate solution of [Non-Crystalline Resin 11'] (40 parts), [Wax Dispersion Liquid] (60 parts), and [Master Batch 11'] (16 parts) were added thereto, and the resultant was stirred at 50° C. with a TK homomixer (manufactured by Primix Corporation) at 5,000 rpm, to be dissolved and dispersed uniformly, to thereby obtain [Pigment/Wax Dispersion Liquid 11']. [Pigment/Wax Dispersion Liquid 11'] was retained in a vessel so as to be kept at 50° C., and used within 5 hours from the manufacture so as not to be crystallized.

~Synthesis of Fine Resin Particle Emulsion~

A reaction vessel equipped with a stirring bar and a thermometer was charged with water (580 parts), styrene (120 parts), methacrylic acid (120 parts), butyl acrylate (45 parts), and alkylallylsulfosuccinic acid sodium salt (ELEMINOL JS-2 manufactured by Sanyo Chemical Industries, Ltd.) (10 parts), and ammonium persulfate (1 parts), and they were stirred at 400 rpm for 30 minutes, which resulted in a white emulsion. This emulsion was heated until the internal temperature was raised to 75° C., and reacted for 7 hours. A 1% ammonium persulfate aqueous water (30 parts) was further added thereto, and the resultant was aged at 75° C. for 7 hours, to thereby obtain [Fine Particle Dispersion Liquid 11'].

~Preparation of Aqueous Phase~

Water (880 parts), [Fine Particle Dispersion Liquid 11'] (200 parts), a 48.5% sodium dodecyldiphenyletherdisulfonate aqueous solution (ELEMINOL MON-7 manufactured by Sanyo Chemical Industries, Ltd.) (37 parts), and ethyl acetate (107 parts) were mixed and stirred, to thereby obtain [Aqueous Phase 11'].

~Manufacture of Toner~

Another vessel equipped with a stirrer and a thermometer was charged with [Aqueous Phase 11'] (520 parts) and it was heated to 40° C. [Aqueous Phase 11'] retained at from 40° C. to 50° C. was stirred with a TK homomixer (manufactured by Primix Corporation) at 13,000 rpm, while adding thereto [Pigment/Wax Dispersion Liquid 11'] (260 parts) retained at 50° C. as above, to emulsify the materials for 1 minute, to thereby obtain [Emulsified Slurry 11']. Next, a vessel equipped with a stirrer and a thermometer was charged with [Emulsified Slurry 11'], and it was desolventized at 60° C. for 6 hours, to thereby obtain [Dispersed Slurry 11'].

This [Dispersed Slurry 11'] was filtered at reduced pressure, and subjected to the following series of washing process.

That is, ion-exchanged water (100 parts) was added to the obtained filtration cake, and they were mixed with a TK homomixer (at 6,000 rpm for 5 minutes), and then filtered. A 10% sodium hydroxide aqueous solution (100 parts) was added to the obtained filtration cake, and they were mixed with a TK homomixer (at 6,000 rpm for 10 minutes), and then filtered. Then, 10% hydrochloric acid (100 parts) was added to the obtained filtration cake, and they were mixed with a TK homomixer (at 6,000 rpm for 5 minutes), and then filtered. Then, an operation of adding ion-exchanged water (300 parts) to the obtained filtration cake, mixing them with a TK homomixer (at 6,000 rpm for 5 minutes), and then filtering the mixture was repeated twice, to thereby obtain [Filtration Cake 11'].

The obtained [Filtration Cake 11'] was dried with an air-circulating drier at 45° C. for 48 hours, and after this, sieved with a mesh having a mesh size of 75 μm, to thereby obtain [Toner Base Particles 11'].

The obtained [Toner Base Particles 11'] (100 parts), and hydrophobized silica having a particle diameter of 13 nm (1 part) were mixed with a Henschel mixer to thereby obtain [Toner 11']. The thickness of the shell was 53 nm.

Comparative Example 12

[Toner 12'] was obtained in the same manner as Example 16, except that the following [Aqueous Phase 12'] was used instead of [Fine Particle Dispersion Liquid 7]. The thickness of the shell was 41 nm.

~Manufacture of Aqueous Phase~

Another vessel equipped with a stirrer and a thermometer was charged with ion-exchanged water (75 parts), a 25% dispersion liquid of fine organic resin particles (copolymer of styrene-methacrylic acid-butyl acrylate-sodium salt of methacrylic acid-ethylene oxide adduct sulfate) (manufactured by Sanyo Chemical Industries, Ltd.) (3 parts), carboxymethylcellulose sodium (CELLOGEN BS-H-3 manufactured by Daiichi Kogyo Co., Ltd.) (1 part), a 48.5% sodium dodecyldiphenyletherdisulfonate aqueous solution (ELEMINOL MON-7 manufactured by Sanyo Chemical Industries, Ltd.) (16 parts), and ethyl acetate (5 parts), and they were mixed and stirred at 40° C., to thereby manufacture [Aqueous Phase 12'].

Comparative Example 13

[Toner 13'] was obtained in the same manner as Comparative Example 12, except that the following [Oil Phase 13'], [Emulsified Slurry 13'], [Slurry 13'], [Filtration Cake 13'], and [Toner Base Particles 13'] were used. The thickness of the shell was 42 nm.

A vessel equipped with a thermometer and a stirrer was charged with [Block Copolymer Resin 16] (94 parts) and ethyl acetate (81 parts), and they were heated to equal to or higher than the melting point of the resin, to be dissolved well. [Wax Dispersion Liquid 16] (25 parts) and [Master Batch 16] (12 parts) were added thereto, and the resultant was stirred at 50° C. with a TK homomixer (manufactured by Primix Corporation) at 10,000 rpm, to be dissolved and dispersed uniformly, to thereby obtain [Oil Phase 13']. [Oil Phase 13'] was retained in a vessel so as to be kept at a temperature of 50° C.

Next, [Oil Phase 13'] (50 parts) retained at the 50° C. was added to the whole amount of [Aqueous Phase 12'], and they were mixed at from 45° C. to 48° C. with a TK homomixer (manufactured by Primix Corporation) at 12,000 rpm for 1 minute, to thereby obtain [Emulsified Slurry 13'].

A vessel equipped with a stirrer and a thermometer was charged with [Emulsified Slurry 13'], and it was desolventized at 50° C. for 2 hours, to thereby obtain [Slurry 13'].

The obtained [Slurry 13'] (100 parts) of toner base particles was filtered at reduced pressure, and subjected to the following series of washing process.

That is, ion-exchanged water (100 parts) was added to the obtained filtration cake, and they were mixed with a TK homomixer (at 6,000 rpm for 5 minutes), and then filtered. A 10% sodium hydroxide aqueous solution (100 parts) was added to the obtained filtration cake, and they were mixed with a TK homomixer (at 6,000 rpm for 10 minutes), and then filtered at reduced pressure. Then, 10% hydrochloric acid (100 parts) was added to the obtained filtration cake, and they were mixed with a TK homomixer (at 6,000 rpm for 5 minutes), and then filtered. Then, an operation of adding ion-exchanged water (300 parts) to the obtained filtration cake, mixing them with a TK homomixer (at 6,000 rpm for 5 minutes), and then filtering the mixture was repeated twice, to thereby obtain [Filtration Cake 13'].

The obtained [Filtration Cake 13'] was dried with an air-circulating drier at 45° C. for 48 hours, and after this, sieved with a mesh having a mesh size of 75 μm, to thereby obtain [Toner Base Particles 13'].

Comparative Example 14

~Manufacture of Non-Crystalline Segment~

A 5 L four-necked flask equipped with a nitrogen introducing pipe, a dehydrating pipe, a stirrer, and a thermocouple was charged with propylene glycol as diol and dimethyl terephthalate and dimethyl adipate as dicarboxylic acids such that the ratio of OH group to COOH group (OH/COOH) would be 1.2. The molar ratio between dimethyl terephthalate and dimethyl adipate (dimethyl terephthalate/dimethyl adipate) was 80/20. Titanium tetraisopropoxide was further added thereto in an amount of 300 ppm relative to the mass of all of the monomers charged, and they were reacted while letting water to be produced flow out. They were reacted until they were finally warmed to 230° C. and the acid value of the resin became 5 mgKOH/g or less. After this, they were reacted at reduced pressure of 10 mmHg for 6 hours, to thereby obtain [Crystalline Polyester Resin B14'].

~Manufacture of Crystalline Resin B (Crystalline Polyester Resin B)~

A 5 L four-necked flask equipped with a nitrogen introducing pipe, a dehydrating pipe, a stirrer, and a thermocouple was charged with 1,6-hexanediol as diol and adipic acid as dicarboxylic acid such that the ratio of OH group to COOH group (OH/COOH) would be 1.1, and further with titanium tetraisopropoxide in an amount of 300 ppm relative to the mass of all of the monomers charged, and they were reacted while letting water flow out. After they were reacted until they were finally warmed to 230° C. and the acid value of the resin become 5 mgKOH/g or less, they were reacted at reduced pressure of 10 mmHg or lower for 6 hours, to thereby obtain [Crystalline Polyester Resin B14'].

~Manufacture of Block Copolymer Resin~

A 5 L four-necked flask equipped with a nitrogen introducing pipe, a dehydrating pipe, a stirrer, and a thermocouple was charged with [Non-Crystalline Segment 14'] (1,600 g) and [Crystalline Segment A12'] (400 g), and they were reacted at 60° C. for 2 hours at reduced pressure of 10 mmHg. After nitrogen depressurization, ethyl acetate (2,000 g) dehydrated through molecular sieves 4 A was added thereto, and the resultant was dissolved under nitrogen stream until the materials became uniform.

Next, 4,4'-diphenylmethanediisocyanate (MDI) (136 g) was added to the system, and the resultant was stirred until the materials became uniform visibly. After this, tin 2-ethylhexanoate as a catalyst was added thereto in an amount of 100 ppm relative to the mass of the resin solid content, and the resultant was warmed to 80° C., and reacted under reflux for 5 hours. Next, ethyl acetate was distilled away from the resultant at reduced pressure, to thereby obtain [Block Copolymer Resin 14'].

~Manufacture of Master Batch~

[Block Copolymer Resin 14'] (100 parts), a cyan pigment (C.I. Pigment blue 15:3) (100 parts), and ion-exchanged water (30 parts) were mixed well, and kneaded with an open roll kneader (KNEADEX manufactured by Nippon Coke & Engineering. Co., Ltd.). The kneading was started from 90° C., and after this, the temperature was gradually lowered to 50° C., to thereby obtain [Master Batch 14'] in which the ratio between the resin and the pigment (mass ratio) was 1:1.

~Manufacture of Toner 14'~

<Manufacture of Oil Phase>

A vessel equipped with a thermometer and a stirrer was charged with such an amount of [Block Copolymer resin 14'] that would be 74% of the total solid content of the oil phase, such an amount of [Crystalline Polyester Resin B14'] that would be 15% of the total solid content of the oil phase, and such an amount of ethyl acetate that would result in the oil phase having a total solid content of 50%, and they were heated to equal to or higher than the melting point of the resin, to be dissolved well. Next, such an amount of [Wax Dispersion Liquid 16] that would result in the oil phase containing the wax in an amount of 5% by mass relative to the total solid content thereof, and such an amount of [Master Batch 14'] that would result in the oil phase containing the pigment in an amount of 6% by mass relative to the total solid content thereof were added thereto, and the resultant was stirred at 50° C. with a TK homomixer (manufactured by Primix Corporation) at 10,000 rpm, to be dissolved and dispersed uniformly, to thereby obtain [Oil Phase 14']. [Oil Phase 14'] was retained in a vessel so as to be kept at a temperature of 50° C.

<Manufacture of Slurry>

[Oil Phase 14'] (50 parts) retained at 50° C. was added to [Aqueous Phase 12'] (100 parts), and they were mixed at from 45° C. to 48° C. with a TK homomixer (manufactured by Primix Corporation) at 12,000 rpm for 1 minute, to thereby obtain [Emulsified Slurry 14'].

A vessel equipped with a stirrer and a thermometer was charged with [Emulsified Slurry 14'], and it was desolventized at 50° C. for 2 hours, to thereby obtain [Slurry 14'].

The obtained [Slurry 14'] (100 parts) of toner base particles was filtered at reduced pressure to obtain a filtration cake, which was then subjected to the following series of washing process.

That is, ion-exchanged water (100 parts) was added to the filtration cake, and they were mixed with a TK homomixer (at 6,000 rpm for 5 minutes), and then filtered. A 10% sodium hydroxide aqueous solution (100 parts) was added to the obtained filtration cake, and they were mixed with a TK homomixer (at 6,000 rpm for 10 minutes), and the filtered at reduced pressure. Then, 10% hydrochloric acid (100 parts) was added to the obtained filtration cake, and they were mixed with a TK homomixer (at 6,000 rpm for 5 minutes), and then filtered. Then, an operation of adding ion-exchanged water (300 parts) to the obtained filtration cake, mixing them with a TK homomixer (at 6,000 rpm for 5 minutes), and then filtering the mixture was repeated twice, to thereby obtain [Filtration Cake 14'].

The obtained [Filtration Cake 14'] was dried with an air-circulating drier at 45° C. for 48 hours. After this, it was sieved with a mesh having a mesh size of 75 μm, to thereby obtain [Toner Base Particles 14'].

Next, the obtained [Toner Base Particles 14'] (100 parts) was mixed with hydrophobic silica (HDK-2000 manufactured by Wacker Chemie AG) (1.0 part) and titanium oxide (MT-150AI manufactured by Tayca Corp.) (0.3 parts) with a Henschel mixer, to thereby obtain [Toner 14']. The thickness of the shell was 41 nm.

(Manufacture of Carrier)

The following coating materials were dispersed with a stirrer for 10 minutes to prepare a coating liquid. This coating liquid and a core material were subjected to a coating machine having a rotary bottom plate disk and a stirring blade in a fluid bed and configured to perform coating by forming a circulating current, to thereby coat the core material with the coating liquid. The obtained coated material was burned in an electric furnace at 250° C. for 2 hours, to thereby obtain a ferrite carrier coated with a silicone resin with an average thickness of 0.5 μm and having an average particle diameter of 35 μm.

| Core material | |
|---|---|
| Mn ferrite particles (weight average diameter: 35 μm) | 5,000 parts |

| Coating materials | |
|---|---|
| Toluene | 450 parts |
| Silicone resin SR2400 (manufactured by Dow Corning Toray Co., Ltd., including a 50% non-volatile content) | 450 parts |
| Amino silane SH6020 (manufactured by Dow Corning Toray Co., Ltd.) | 10 parts |
| Carbon black | 10 parts |

(Manufacture of Two-Component Developer)

The above ferrite carrier (100 parts by mass) and the toner of each of Examples and Comparative Examples (7 parts by mass) were mixed uniformly and electrically charged with a turbula mixer configured to stir materials with a tumbling motion of a container, to thereby obtain a two-component developer.

(Evaluation Apparatus)

IMAGIO MP C6000 manufactured by Ricoh Company Limited was modified mainly in the fixing portion, and used as an evaluation apparatus. The apparatus was adjusted to have a linear velocity of 350 mm/sec. The fixing unit of the fixing portion was adjusted to a fixing surface pressure of 40 N/cm$^2$, and to a fixing nip time of 40 ms. A fixing medium was coated on the surface thereof with tetrafluoroethylene/perfluoroalkylvinylether copolymer resin (PFA), shaped, and adjusted on the surface.

(Evaluation Points)

(1) Low Temperature Fixability

Low temperature fixability was evaluated based on minimum fixing temperature.

A solid image was formed on a thick transfer sheet (photocopy paper <135> manufactured by Ricoh Company Limited) with a toner deposition amount of 0.85±0.1 mg/cm$^2$, and subjected to a fixing test by varying the temperature of the fixing belt. The solid image was formed at a position of 3.0 cm from a sheet feeding direction leading end of the sheet.

A picture was drawn on the obtained fixed image with a drawing tester under a load of 50 g, and the temperature of the fixing roller, the image fixed at which temperature was hardly scraped off, was determined as the minimum fixing temperature. Evaluation results based on the following criteria are shown in Table 2.

[Evaluation Criteria]

A: lower than 120° C.

B: 120° C. or higher but lower than 130° C.

C: 130° C. or higher but lower than 140° C.

D: 140° or higher (2) Color Reproducibility

Color reproducibility was evaluated by measuring A*a*b* of a cyan/magenta color-mixed image.

Magenta toners were manufactured in the same manner as Examples 1 to 18 and Comparative Examples 1 to 14, except that the cyan pigment (Pigment blue 15:3) was changed to a magenta pigment (Pigment Red 269), and used for evaluation in combination with the cyan toners of Examples and Comparative Examples.

An overlay solid image of a cyan toner (deposition amount of 0.4±0.02 mg/cm$^2$) and a magenta toner (deposition amount of 0.4±0.02 mg/cm$^2$) was formed on a regular sheet (TYPE 6200 manufactured by Ricoh Company Limited) and fixed thereon at a fixing belt temperature of 160° C. The image was formed such that the magenta toner came to the lower side (sheet side). The overlay solid image was formed at a position of 3.0 cm from the paper feeding direction leading end of the sheet. The measurement was performed with the use of X-RITE 938 (manufactured by X-Rite Inc.), and color reproducibility was determined to be higher as the spread of the lower magenta toner layer, which was distanced farther from the fixing belt, was wider (i.e., as the value a* was greater). Evaluation results based on the following criteria are shown in Table 2.

Color reproducibility depends on the ductility of the toner resin. Therefore, the same effect would be obtained even when the type of the pigment and the combination of the colors are changed.

[Evaluation Criteria]

A: a* was 70.0 or greater.

B: a* was 66.0 or greater but less than 70.0.

C: a* was 63.0 or greater but less than 66.0.

D: a* was less than 63.0.

(3) Heat Resistant Storage Stability

Heat resistant storage stability was evaluated according to penetration test.

A 50 mL glass container was filled with each toner, and retained in a thermostatic bath of 50° C. for 24 hours. The toner was cooled to 24° C., and the penetration (mm) of the toner was measured according to penetration test (JISK2235-1991). Evaluation results of the penetration based on the following criteria are shown in Table 2. Heat resistant storage stability was greater as the value of penetration was greater. When the penetration would be less than 5 mm, a problem would probably arise during use.

[Evaluation Criteria]

A: Penetration was 20 mm or greater.

B: Penetration was 10 mm or greater but less than 20 mm.

C: Penetration was 5 mm or greater but less than 10 mm.

D: Penetration was less than 5 mm.

(4) Scuffing Resistance during Paper Discharging

Scuffing resistance during paper discharging was evaluated by printing a solid image (with a toner deposition amount of 0.6 mg/cm$^2$) on the whole surface of 10 regular sheets (TYPE 6200 manufactured by Ricoh Company Limited) serially, and observing the image visibly.

The evaluation results based on the following criteria are shown in Table 2.

[Evaluation Criteria]

A: No mark of contact with any member after fixing was observed.

B: A slight glossiness difference was observed between a portion having contacted any member and a surrounding portion having contacted nothing, and depending on how to irradiate with light, a mark of contact was recognizable visibly.

C: An apparent glossiness difference was observed between a portion having contacted any member and a surrounding portion having contacted nothing, and a mark of contact was recognizable visibly, or a streaky scuff was observed.

D: An apparent glossiness difference was observed between a portion having contacted any member and a surrounding portion having contacted nothing, and a mark of contact was recognizable visibly, or a streaky scuff was observed where the toner peeled and the surface of the sheet appeared.

TABLE 1

| | Relaxation time (msec) | | | DSC | | | | | Molecular weight | |
|---|---|---|---|---|---|---|---|---|---|---|
| | | | | | | | Max. endothermic peak temp. (° C.) at second | Amount of heat of melting (J/g) at | Ratio of content (%) having molecular weight of 100,000 | |
| | $t_2$ | $t_H$ | $T_S$ | T1 (° C.) | T2 (° C.) | T1 − T2 (° C.) | temp. raise | second temp. raise | or greater | Mw |
| Ex. 1 | 5.51 | 1.04 | 28.00 | 67.1 | 39.6 | 27.5 | 63.2 | 37.1 | 5.8 | 38,000 |
| Ex. 2 | 4.23 | 0.97 | 27.93 | 69.2 | 40.3 | 28.9 | 64.0 | 36.3 | 6.3 | 39,000 |
| Ex. 3 | 2.34 | 1.11 | 17.43 | 68.8 | 43.5 | 25.3 | 64.1 | 29.2 | 7.1 | 48,000 |
| Ex. 4 | 3.89 | 1.95 | 18.52 | 67.3 | 41.1 | 26.2 | 63.3 | 30.9 | 6.9 | 42,000 |

TABLE 1-continued

| | Relaxation time (msec) | | | DSC | | | | | Molecular weight | |
|---|---|---|---|---|---|---|---|---|---|---|
| | $t_2$ | $t_H$ | $T_S$ | T1 (° C.) | T2 (° C.) | T1 − T2 (° C.) | Max. endothermic peak temp. (° C.) at second temp. raise | Amount of heat of melting (J/g) at second temp. raise | Ratio of content (%) having molecular weight of 100,000 or greater | Mw |
| Ex. 5 | 1.81 | 1.15 | 6.50 | 71.5 | 46.8 | 24.7 | 67.2 | 24.3 | 8.7 | 59,000 |
| Ex. 6 | 2.80 | 1.89 | 5.89 | 70.9 | 43.3 | 27.6 | 66.9 | 25.5 | 8.3 | 56,000 |
| Ex. 7 | 5.89 | 1.97 | 28.67 | 62.1 | 37.7 | 24.4 | 61.3 | 41.3 | 5.2 | 40,000 |
| Ex. 8 | 5.52 | 1.19 | 28.03 | 63.0 | 38.8 | 24.2 | 61.5 | 40.1 | 5.3 | 41,000 |
| Ex. 9 | 7.00 | 1.16 | 33.25 | 66.4 | 35.5 | 30.9 | 59.6 | 47.7 | 4.7 | 19,000 |
| Ex. 10 | 6.01 | 0.94 | 33.03 | 67.4 | 36.1 | 31.3 | 60.0 | 45.9 | 4.8 | 20,000 |
| Ex. 11 | 5.85 | 1.14 | 25.03 | 67.1 | 38.1 | 29.0 | 61.9 | 35.5 | 5.1 | 26,000 |
| Ex. 12 | 4.99 | 1.23 | 25.41 | 67.8 | 40.7 | 27.1 | 62.0 | 34.6 | 5.2 | 26,000 |
| Ex. 13 | 2.64 | 1.13 | 11.56 | 64.6 | 40.2 | 24.4 | 63.9 | 23.6 | 5.7 | 32,000 |
| Ex. 14 | 3.55 | 1.90 | 12.01 | 63.8 | 38.9 | 24.9 | 63.0 | 27.5 | 5.5 | 30,000 |
| Ex. 15 | 6.71 | 0.98 | 32.20 | 58.4 | 28.0 | 30.4 | 58.2 | 47.8 | 5.0 | 19,000 |
| Ex. 16 | 1.82 | 2.00 | 23.51 | 65.5 | 37.2 | 28.3 | 60.0 | 45.0 | 7.5 | 65,000 |
| Ex. 17 | 6.23 | 1.98 | 25.01 | 67.3 | 37.9 | 29.4 | 61.8 | 35.8 | 5.1 | 26,000 |
| Ex. 18 | 3.51 | 1.12 | 24.94 | 65.0 | 38.5 | 26.5 | 62.0 | 34.5 | 5.1 | 23,000 |
| Comp. Ex. 1 | 7.11 | 2.03 | 27.77 | 66.7 | 36.4 | 30.3 | 62.5 | 38.1 | 5.3 | 31,000 |
| Comp. Ex. 2 | 1.64 | 0.89 | 19.03 | 69.0 | 44.5 | 24.5 | 65.2 | 27.6 | 7.9 | 48,000 |
| Comp. Ex. 3 | 0.98 | 0.90 | 5.27 | 72.1 | 47.3 | 24.8 | 68.5 | 21.4 | 9.1 | 60,000 |
| Comp. Ex. 4 | 7.97 | 2.10 | 33.11 | 65.7 | 33.4 | 32.3 | 58.2 | 48.9 | 4.6 | 18,000 |
| Comp. Ex. 5 | 7.11 | 2.10 | 25.85 | 66.8 | 34.1 | 32.7 | 61.1 | 37.1 | 4.9 | 25,000 |
| Comp. Ex. 6 | 1.76 | 0.81 | 11.89 | 65.3 | 41.3 | 24.0 | 64.0 | 22.4 | 6.0 | 35,000 |
| Comp. Ex. 7 | 8.10 | 2.04 | 33.46 | 58.1 | 28.2 | 29.9 | 58.3 | 45.5 | 4.9 | 19,000 |
| Comp. Ex. 8 | 1.62 | 0.07 | 17.45 | 62.9 | 33.7 | 29.2 | 61.1 | 35.2 | 8.1 | 40,000 |
| Comp. Ex. 9 | 1.73 | 0.06 | 24.82 | 60.1 | 40.7 | 19.4 | 58.2 | 60.1 | 6.2 | 31,000 |
| Comp. Ex. 10 | 1.54 | 0.07 | 17.00 | 63.2 | 37.9 | 25.3 | 60.8 | 36.6 | 6.6 | 35,000 |
| Comp. Ex. 11 | 1.66 | 0.06 | 23.00 | 59.5 | 39.2 | 20.3 | 58.4 | 61.3 | 7.0 | 25,000 |
| Comp. Ex. 12 | 1.78 | 1.09 | 23.61 | 66.0 | 38.2 | 27.8 | 63.4 | 45.1 | 7.3 | 60,000 |
| Comp. Ex. 13 | 1.68 | 0.97 | 22.09 | 67.0 | 39.3 | 27.7 | 64.0 | 46.0 | 7.5 | 63,000 |
| Comp. Ex. 14 | 1.53 | 0.96 | 19.50 | 70.1 | 40.1 | 30.0 | 68.3 | 39.8 | 8.2 | 65,000 |

TABLE 2

| | Low temp. fixability | Color reproducibility | Heat resistant storage stability | Scuffing resistance during paper discharging |
|---|---|---|---|---|
| Ex. 1 | A | B | B | B |
| Ex. 2 | B | B | B | B |
| Ex. 3 | C | C | A | A |
| Ex. 4 | B | B | B | B |
| Ex. 5 | C | C | A | A |
| Ex. 6 | C | C | C | B |
| Ex. 7 | A | A | B | B |
| Ex. 8 | A | B | B | B |
| Ex. 9 | A | A | C | C |
| Ex. 10 | A | C | B | B |
| Ex. 11 | A | B | B | B |
| Ex. 12 | B | B | B | A |
| Ex. 13 | C | C | B | A |
| Ex. 14 | B | C | C | B |
| Ex. 15 | A | B | C | C |
| Ex. 16 | A | C | A | A |
| Ex. 17 | A | A | B | B |
| Ex. 18 | B | B | B | B |
| Comp. Ex. 1 | A | A | D | C |
| Comp. Ex. 2 | C | D | A | A |
| Comp. Ex. 3 | D | D | A | A |
| Comp. Ex. 4 | A | A | D | D |
| Comp. Ex. 5 | A | B | D | C |
| Comp. Ex. 6 | C | D | A | A |
| Comp. Ex. 7 | A | A | D | D |
| Comp. Ex. 8 | C | D | B | A |
| Comp. Ex. 9 | A | D | C | B |
| Comp. Ex. 10 | C | D | B | A |
| Comp. Ex. 11 | A | D | C | B |
| Comp. Ex. 12 | A | D | A | A |
| Comp. Ex. 13 | A | D | A | A |
| Comp. Ex. 14 | A | D | A | A |

The invention claimed is:

1. A toner, comprising:

a colorant;

a crystalline resin; and a releasing agent, wherein a spin-spin relaxation time ($t_2$) of the toner at 90° C. obtained by Hahn Echo method of pulse NMR analysis is from 1.80 msec to 7.00 msec, wherein the crystalline resin comprises a crystalline polyester resin and the crystalline polyester resin comprises a urethane bond, a urea bond, or both thereof.

2. The toner according to claim 1, wherein the spin-spin relaxation time ($t_2$) of the toner at 90° C. obtained by Hahn Echo method of pulse NMR analysis is from 3.80 msec to 5.90 msec.

3. The toner according to claim 1, wherein of a soft component and a hard component of the toner at 90° C. obtained by Hahn Echo method of pulse NMR analysis, the hard component has a spin-spin relaxation time ($t_H$) that satisfies the following relational expression <1> or <2> where $t_S$ represents a spin-spin relaxation time attributed to the soft component:

$$\text{when } t_S \geq 25.00 \text{ msec}, t_H \leq 2.00 \text{ msec} \quad \langle 1 \rangle,$$

$$\text{when } t_S < 25.00 \text{ msec}, t_H \geq 1.10 \text{ msec} \quad \langle 2 \rangle.$$

4. The toner according to claim 1, wherein in DSC of the toner in a range of from 0° C. to 100° C., a maximum endothermic peak temperature T1 of the toner at a first temperature raising and a maximum exothermic peak temperature T2 of the toner at a temperature lowering satisfy the following relational expression <3>:

$$T1 - T2 \leq 30.0° \text{ C. and } T2 \geq 30.0° \text{ C.} \quad \langle 3 \rangle.$$

5. The toner according to claim 4, wherein in the DSC of the toner in the range of from 0° C. to 100° C., a maximum endothermic peak temperature of the toner at a second temperature raising is in a range of from 50° C. to 70° C., and an amount of heat of melting of the toner at the second temperature raising is 30.0 J/g or greater.

6. The toner according to claim 1, wherein when a tetrahydrofuran (THF) soluble content of the toner is measured with gel permeation chromatography (GPC), a ratio of a content of the THF soluble content that has a molecular weight of 100,000 or greater is 5% or greater, and a weight average molecular weight (Mw) of the THF soluble content is 20,000 or greater.

7. The toner according to claim 1, wherein the toner has a core-shell structure, and a shell of the core-shell structure has a thickness of 40 nm or less.

8. A two-component developer, comprising:

the toner according to claim 1; and a carrier having a magnetic property.

9. The toner according to claim 1, which further comprises a non-crystalline polyester resin.

10. The toner according to claim 9, wherein the non-crystalline polyester resin is a modified polyester resin.

11. The toner according to claim 9, wherein the non-crystalline polyester resin is an unmodified polyester resin.

12. The toner according to claim 1, which contains 10% by mass to 85% by mass of the crystalline resin.

13. The toner according to claim 1, which has a glass transition temperature of 40° C. to 70° C.

14. The toner according to claim 1, which contains 1% by mass to 15% by mass of the colorant.

15. The toner according to claim 1, wherein the releasing agent is a wax.

16. The toner according to claim 1, wherein the releasing agent is a wax having a melting point of 40° C. to 160° C.

17. The toner according to claim 1, wherein the releasing agent is a wax and the toner comprises up to 40% by mass of the wax.

18. The toner according to claim 1, wherein the releasing agent is a wax and the toner comprises 3% by mass to 30% by mass of the wax.

* * * * *